US009759520B2

(12) United States Patent
Hancosky

(10) Patent No.: US 9,759,520 B2
(45) Date of Patent: Sep. 12, 2017

(54) METHOD AND SYSTEM FOR ALIGNING A POINT OF AIM WITH A POINT OF IMPACT FOR A PROJECTILE DEVICE

(71) Applicant: Umarex USA, Inc., Fort Smith, AR (US)

(72) Inventor: Jack Hancosky, Avoca, NY (US)

(73) Assignee: Umarex USA, Inc., Fort Smith, AR (US)

( * ) Notice: Subject to any disclaimer, the term of this patent is extended or adjusted under 35 U.S.C. 154(b) by 0 days.

(21) Appl. No.: 15/192,630

(22) Filed: Jun. 24, 2016

(65) Prior Publication Data

US 2016/0298929 A1 Oct. 13, 2016

Related U.S. Application Data

(60) Continuation of application No. 14/823,897, filed on Aug. 11, 2015, now Pat. No. 9,435,612, which is a continuation-in-part of application No. 14/288,872, filed on May 28, 2014, which is a division of application No. 13/667,070, filed on Nov. 2, 2012, now Pat. No. 8,769,858, said application No.

(Continued)

(51) Int. Cl.

| | |
|---|---|
| ***F41G 1/00*** | (2006.01) |
| ***F41G 3/00*** | (2006.01) |
| ***F41G 1/35*** | (2006.01) |
| ***F41G 1/54*** | (2006.01) |
| ***F41G 1/34*** | (2006.01) |
| ***F41J 2/00*** | (2006.01) |
| ***F41G 3/32*** | (2006.01) |
| *F41G 1/38* | (2006.01) |

(52) U.S. Cl.

CPC ..... *F41G 3/005* (2013.01); *F41G 1/345* (2013.01); *F41G 1/35* (2013.01); *F41G 1/54* (2013.01); *F41G 1/545* (2013.01); *F41G 3/323* (2013.01); *F41J 2/00* (2013.01); *F41G 1/38* (2013.01)

(58) Field of Classification Search

CPC ..... F41G 3/06; F41G 3/08; F41G 3/02; F41G 3/326; F41G 3/142; F41G 3/145; F41G 3/2627; F41G 3/2644; F41G 3/2655; F41G 1/473; F41G 1/54; F41G 1/35; F41G 1/38; F41G 1/30; F41G 1/00; F41G 1/545

USPC ..... 89/14.2, 14.3

See application file for complete search history.

(56) References Cited

U.S. PATENT DOCUMENTS 4,570,529 A * 2/1986 A'Costa ..... F41A 21/34 42/78

4,664,014 A * 5/1987 Hawley ..... F41A 21/34 89/14.2

(Continued)

*Primary Examiner* — Samir Abdosh

(74) *Attorney, Agent, or Firm* — Winthrop & Weinstine, P.A.

(57) ABSTRACT

Methods and systems for aligning a point of aim with a point of impact for a projectile device are disclosed. Using a superposition device coupled to the projectile device, at least one optical reference point is superposed within a first target area with at least one beam from the superposition device. A position of at least one of the optical reference points is noted. A projectile is expelled from the projectile device at a second target area, while the position of the at least one optical reference point is maintained, to create the point of impact. The point of aim for the projectile device is adjusted to align with the point of impact while the position of the at least one optical reference point is maintained.

13 Claims, 35 Drawing Sheets

Related U.S. Application Data

14/823,897 is a continuation-in-part of application No. 13/865,643, filed on Apr. 18, 2013, now Pat. No. 9,303,951, which is a continuation-in-part of application No. 13/667,070, filed on Nov. 2, 2012, now Pat. No. 8,769,858.

(56) References Cited

U.S. PATENT DOCUMENTS 4,893,544 A * 1/1990 Hawley ..... F41A 21/34 89/14.2
5,005,463 A * 4/1991 A'Costa ..... F41A 21/34 89/14.2
5,092,223 A * 3/1992 Hudson ..... F41A 21/38 89/14.2
5,359,779 A * 11/1994 Polk ..... F41G 1/35 33/DIG. 21
5,410,815 A * 5/1995 Parikh ..... F41A 33/02 33/275 R
5,491,546 A * 2/1996 Wascher ..... F41G 1/38 356/20
5,596,161 A * 1/1997 Sommers ..... F41A 21/34 89/14.2
6,124,968 A * 9/2000 Pieri ..... F41H 5/266 359/402
6,230,431 B1 * 5/2001 Bear ..... F41G 1/35 362/114
6,397,509 B1 * 6/2002 Langner ..... F41G 1/54 42/111
7,796,329 B2 * 9/2010 Dobschal ..... F41G 1/30 359/1
7,861,636 B1 * 1/2011 Hoffman ..... F41A 21/34 89/14.2
D646,345 S * 10/2011 Oliver ..... D22/108
8,061,254 B2 * 11/2011 Heath ..... F41A 21/34 89/14.2
8,104,394 B2 * 1/2012 Meyers ..... F41A 21/34 42/77
8,453,789 B1 * 6/2013 Honigmann ..... F41A 21/30 181/223
8,484,881 B2 * 7/2013 Lindlau ..... F41G 1/30 42/119
9,062,932 B2 * 6/2015 Houde-Walter ..... F41G 1/35
9,372,051 B2 * 6/2016 Kepler ..... G01B 11/272
2008/0104875 A1 * 5/2008 Mayerle ..... F41G 1/41 42/118
2012/0055063 A1 * 3/2012 Lindau ..... F41G 1/30 42/113
2015/0198415 A1 * 7/2015 Campean ..... F41G 1/18 42/137

* cited by examiner

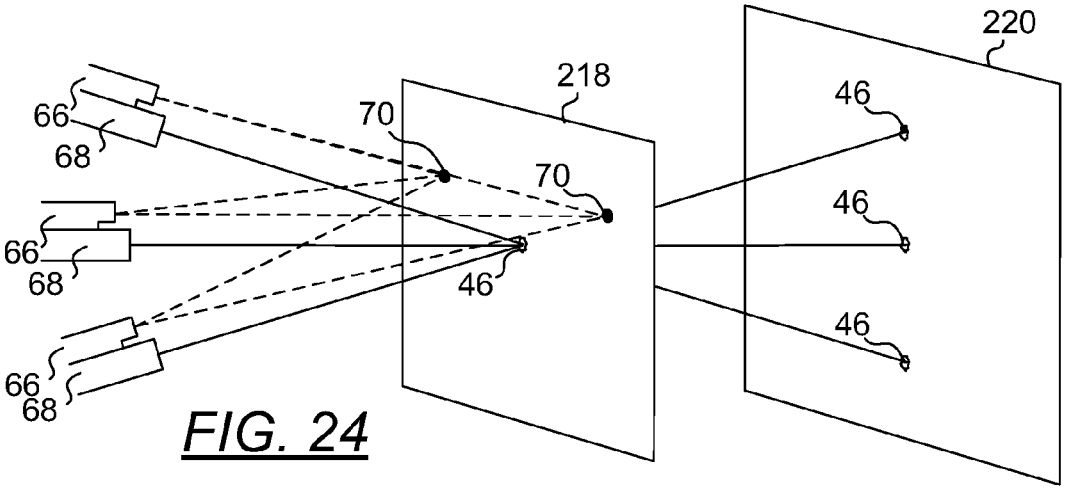
FIG. 24
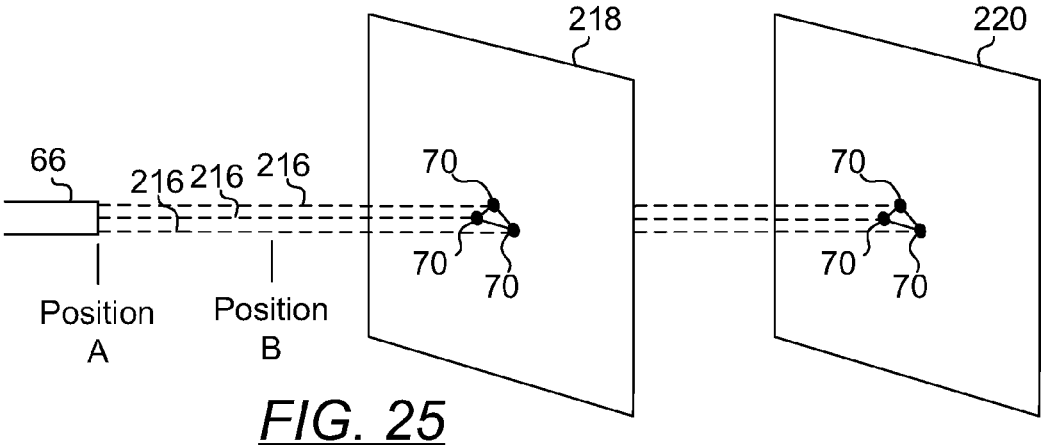
FIG. 25
FIG. 26
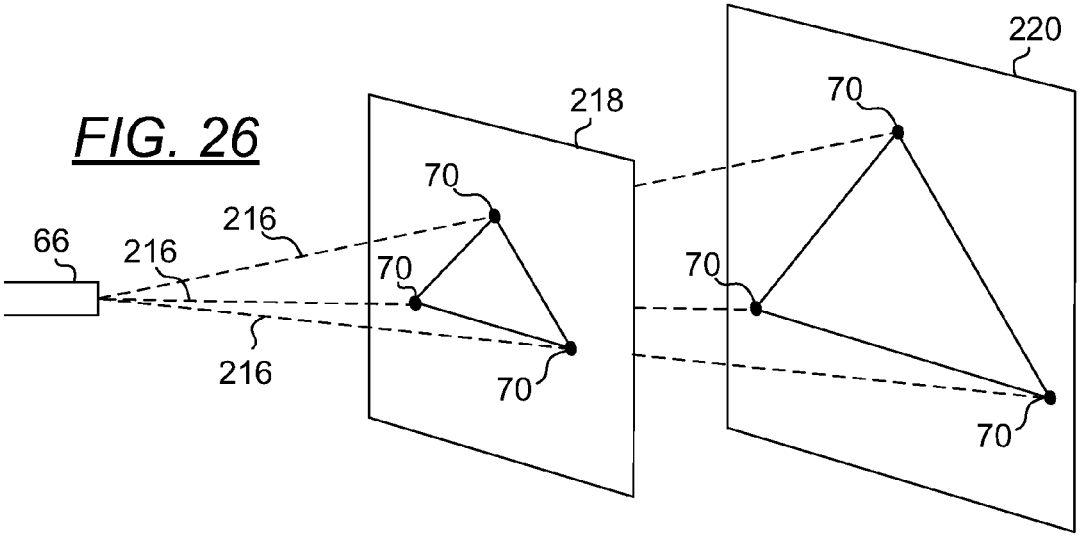

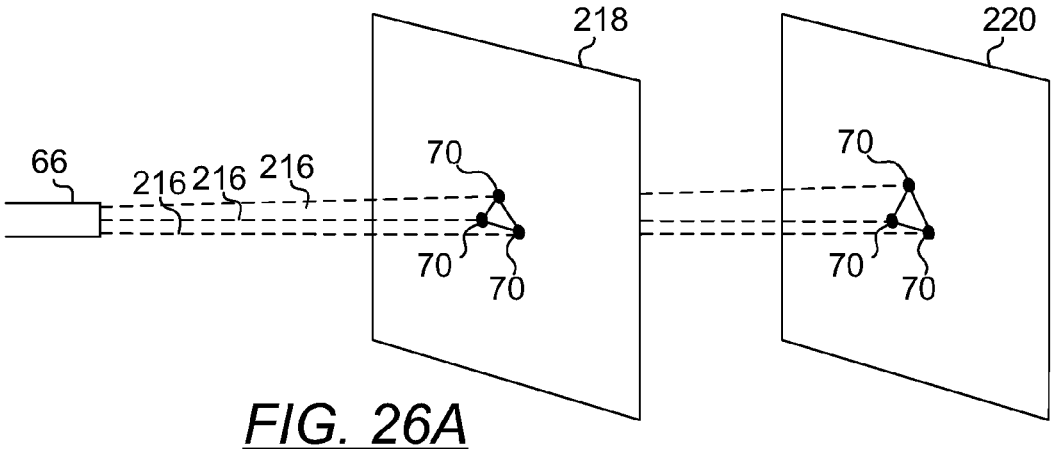
FIG. 26A
FIG. 26B
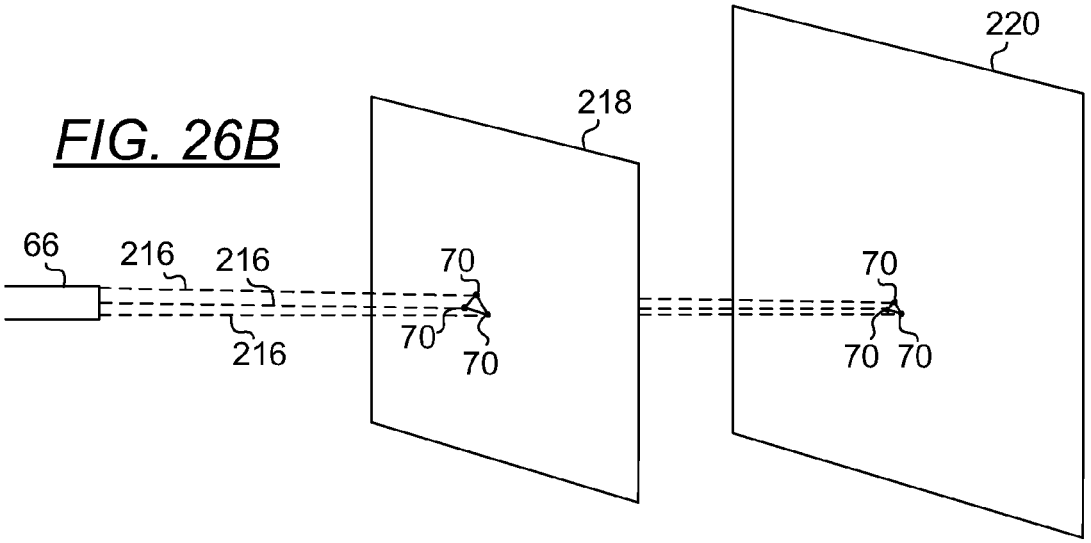

FIG. 42
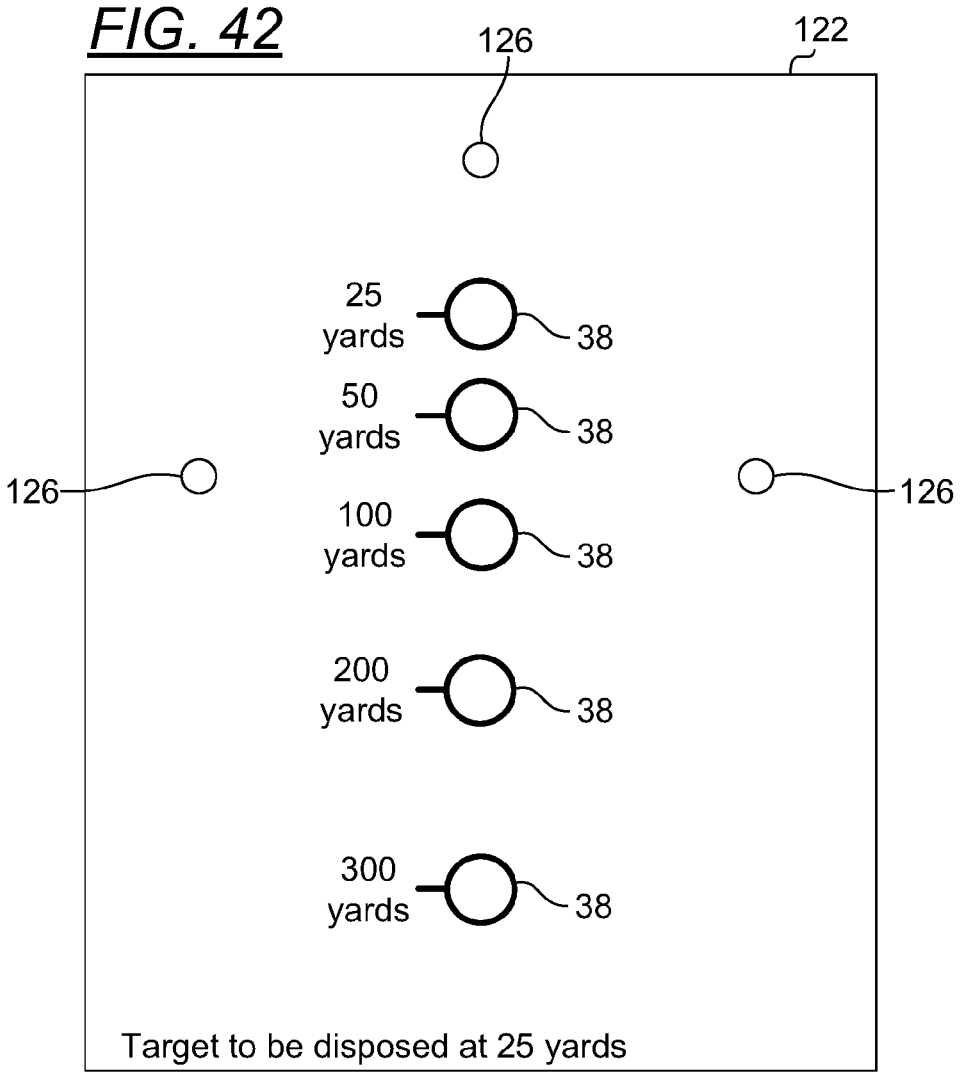
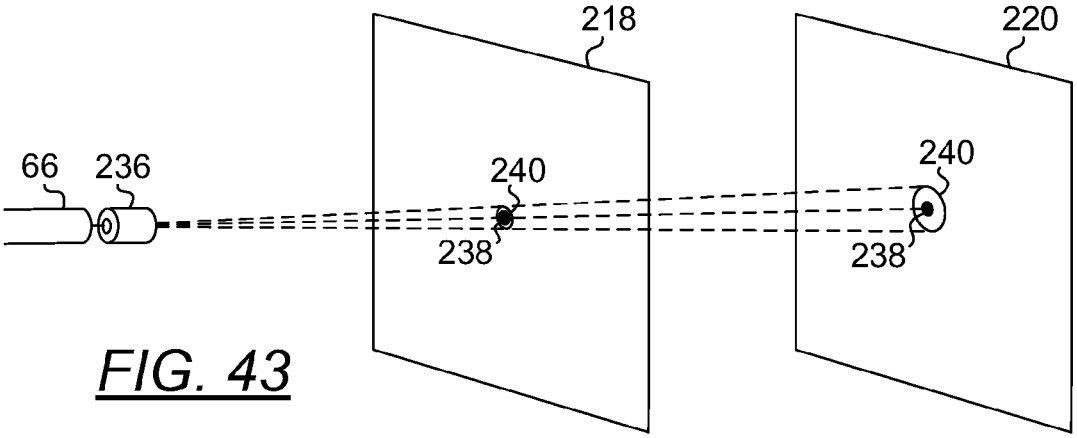
FIG. 43

METHOD AND SYSTEM FOR ALIGNING A POINT OF AIM WITH A POINT OF IMPACT FOR A PROJECTILE DEVICE

CROSS-REFERENCE TO RELATED APPLICATIONS

This application is a continuation of U.S. patent application Ser. No. 14/823,897, filed Aug. 11, 2015, which is a continuation-in-part of U.S. patent application Ser. No. 14/288,872, filed May 28, 2014, which is a divisional of U.S. patent application Ser. No. 13/667,070, filed Nov. 2, 2012, now U.S. Pat. No. 8,769,858, issued Jul. 8, 2014, which are herein incorporated by reference in their entirety. U.S. patent application Ser. No. 14/823,897, filed Aug. 11, 2015, which is herein incorporated by reference in its entirety is also a continuation-in-part of U.S. patent application Ser. No. 13/865,643, filed Apr. 18, 2013, now U.S. Pat. No. 9,303,951, issued Apr. 5, 2016, which is a continuation-in-part of U.S. patent application Ser. No. 13/667,070, filed Nov. 2, 2012, now U.S. Pat. No. 8,769,858, issued Jul. 8, 2014, which are herein incorporated by reference in their entirety.

STATEMENT REGARDING FEDERALLY SPONSORED RESEARCH OR DEVELOPMENT

Not applicable.

TECHNICAL FIELD

The claimed invention generally relates to firearms and other projectile devices. More particularly, the claimed invention relates to methods and systems for aligning a point of aim with a point of impact for a projectile device. The claimed invention also relates to methods and systems for indicating a relationship between a point of aim and a point of impact for a projectile device.

BACKGROUND

Firearms, and other projectile devices such as air guns, pellet guns, and bows, are often provided with an aiming device such as, but not limited to a scope, an iron sight, a dot sight, a holographic sight, a shotgun sight, a bead sight, or a ramp sight.

In order for the aiming device to have an increased effectiveness, it is important to check and adjust the projectile device and its aiming device such that a point of impact of a projectile launched by the projectile device is aligned with the point of aim of the aiming device. Such alignment, or zeroing of the point of aim and point of impact can make the projectile device far more accurate than a non-aligned or non-zeroed device.

In order to understand existing zeroing processes, it is helpful to look at the trajectory of a projectile fired by a projectile device in comparison to a point of aim for the same projectile device. For convenience, a rifle will be used throughout this specification as an example of a projectile device, but it should be understood that projectile devices include, but are not limited to rifles, pistols, shotguns, firearms, BB guns, pellet guns, air guns, cannons, and bows. FIG. 1 schematically illustrates an example of a person aiming a rifle 30 over a distance of one hundred yards using a scope 32. For convenience, a scope will be used throughout this specification as an example of an aiming device coupled to the projectile device. However, it should be understood that aiming devices include, but are not limited to scopes, iron sights, dot sights, holographic sights, shotgun sights, bead sights, and ramp sights.

The person of FIG. 1 looks through the scope 32 and has a point of aim which may lie along an imaginary sight line 34 which results from an orientation of the scope 32 (for example an up/down or left/right orientation of the scope), an orientation of an optical axis within the scope, and position of the person's eye relative the scope and its optical axis. The sight line 34, along which the point of aim may lie, is a straight line.

A projectile, in this example a bullet, when fired from the rifle 30 will follow a curved path 36 due to the effect of gravity. In the example of FIG. 1, looking at the curves only in the two dimensions of the page, the curved path 36, or trajectory, crosses the line of sight 34 at two points. For this example, those two points are twenty-five yards and two hundred yards. A change in alignment between the optical axis of the scope and the rifle can cause the projectile trajectory to cross the line of sight at different locations or not at all.

Looking only in the two dimensions of FIG. 1, if the desired point of aim was at twenty-five yards or two hundred yards, then the rifle 30 would be zeroed at those distances because the point of aim is aligned with the point of impact at the desired distance. In reality, a projectile device needs to be zeroed in three dimensions. For example, FIG. 2 schematically illustrates a view of a target ring 38 through a scope 32. The point of aim 40 is where the scope's crosshairs 42, 44 meet. An operator has the point of aim directly in the middle of the target ring 38, but FIG. 2 also illustrates an example bullet hole marking a point of impact 46 from when the rifle was fired with the point of aim 40 in the target ring 38. Therefore, zeroing must be performed in three dimensions: for example, up/down, left/right, and out to a particular distance.

Numerous situations may create a need to zero a projectile device, including, but not limited to: if the projectile device is new; if the projectile device has a newly installed aiming device; if the projectile device has been dropped, bumped, or otherwise been roughly handled (the projectile device undergoes traumatic impact); if the projectile device has been dismantled and put back together; if the projectile device has been fired numerous times; if the distance of the desired point of aim changes; if different projectiles (as one example, different ammunition) will be used with the projectile device; and if a different operator will be using the projectile device.

Various solutions have been proposed to help with the zeroing of projectile devices. For example, a recursive solution utilizing multiple rounds (projectiles) is often used when trying to zero projectile devices. As an example of such a recursive solution, a person with a rifle having a scope may aim at a target and then fire. Assuming the rifle starts off aligned to at least shoot the bullet in the vicinity of the point of aim (for example, on a same target area), then the person may measure a horizontal offset 48 and a vertical offset 50 (as illustrated in FIG. 2) between the point of impact 46 and the point of aim 40. Some scopes are equipped with horizontal and vertical adjustment knobs/screws which can then be twisted, dialed, or clicked a particular number of times, per a manufacturer's instructions to compensate for the horizontal offset 48 and vertical offset 50. Unfortunately, it is often difficult to determine how far to turn the adjustment dials because the manufacturers guidelines may be based on a distance different from the desired zeroing distance. Furthermore, the scope adjustment knobs often create audible clicks as they are turned. These clicks need to be counted, but they may be hard to hear in certain environments, especially if hearing protection is being worn (as is often the case around certain firearms). To make matters worse, the springs inside many of the scope adjustment knobs often relax over time, resulting in inaccurate offset compensation even if a desired number of clicks or adjustment turns is used. Given such variability in scope adjustment, a follow-up round, when fired at the target, will most likely not coincide with the point of aim. The process then needs to be repeated, often five to ten times or more. The process is also further complicated and delayed if the scope adjustments are more rudimentary and/or if the projectile device operator is not highly skilled.

Such zeroing techniques can be very wasteful of ammunition or other projectiles. Considering that single rounds of ammunition often cost $1.00 or more each, an enthusiast may be spending $10-20 or more just to zero his weapon each time. According to the National Rifle Association, in 2010 people owned three hundred million firearms in the U.S. alone. Military and law enforcement organizations are also large consumers and users of firearms and other projectile devices which need to be zeroed frequently. The potential reduction in waste and cost savings are staggering if a more efficient method of zeroing projectile devices can be discovered.

Some have proposed methods for zeroing a projectile device which utilize a laser arbor that can be inserted into the barrel of a rifle or other firearm. The laser arbor may be magnetized to temporarily adhere to the inside of the rifle barrel or a properly sized caliber arbor can lodge against the bore while the laser light is shined towards a target as a surrogate for a point of impact since it originated coaxially with the rifle barrel. The scope, or other aiming device, however, cannot be aligned with the laser light since the light travels in a straight line as opposed to the curved trajectory of a bullet. Therefore, if the laser light from such arbor devices is projected onto a target, the scope's point of aim must be aligned somewhere else offset from the laser. This increases the opportunity for human error. Such errors can be complicated by wobble from the magnetically attached laser arbor. Furthermore, some firearms can't be used with a magnetic laser arbor because the barrels are not iron-based and therefore non-magnetic. On top of this, the more serious firearm enthusiasts will not use such a device which intrudes into the barrel crown because it may cause distortion to the barrel's grooving. Still further, such methods require a minimum of two rounds (one initial shot, and at least one follow-up shot to compensate for the flat laser trajectory).

In an attempt to overcome objections to barrel crown intrusion, some manufacturers have created laser cartridges which can be cambered to shine laser light down the inside length of a rifle barrel and out onto a target. While crown insertion is avoided, the linear trajectory of the laser results in similar downfalls to the previously described solution. Furthermore, the spot radius of existing cartridge lasers is quite large, making it further difficult to zero the point of aim onto a point of impact.

Other zeroing solutions provide magnetic grids which can be stuck onto the end of a rifle barrel, rather than inserted into the bore. The scope is then aligned with the grid visible at the end of the barrel. Such methods are useful for "getting a shot on paper" (hitting a paper target), but then usually one of the above methods is needed, typically the recursive method, to truly align the point of aim with the point of impact. Furthermore, as yet another magnetic method, such a technique does not work with firearms made from non-iron-based materials.

Therefore, there is a need for a more efficient, reliable, and money and ammunition saving method and system for aligning a point of aim with a point of impact for a projectile device. Additionally, there is a need for a method and system of indicating a relationship between a point of aim and a point of impact for a projectile device so that a previously zeroed projectile device may be more quickly checked for zero and realigned if necessary in an efficient manner.

SUMMARY

A system for aligning a point of aim with a point of impact for a projectile device includes a scope configured to be coupled to the projectile device, a sight aid for removing parallax when optically coupled with the scope, and at least one superposition device configured to be coupled to the projectile device. The at least one superposition device includes at least one illumination source for superposing multiple optical reference points onto a first target. The point of aim is adjustable to align with the point of impact while maintaining a position of at least one of the multiple optical reference points superposed on the first target.

A method of aligning a point of aim with a point of impact for a projectile device includes providing a scope configured to be coupled to the projectile device, providing a sight aid for removing parallax when optically coupled with the scope, providing at least one superposition device coupled to the projectile device, collimating the at least one illumination source, superposing at least one of the multiple optical reference points on a first target, expelling a projectile from the projectile device towards a second target, creating the point of impact on the second target with the projectile, and adjusting the point of aim to align with the point of impact while maintaining a position of the at least one of the multiple optical reference points on the first target. The at least one superposition device includes at least one illumination source for superposing multiple optical reference points onto the first target.

BRIEF DESCRIPTION OF THE DRAWINGS

FIG. 8A-1 schematically illustrates an embodiment of using at least one projection device coupled to a projectile device to project multiple optical reference points within a first target area that coincides with a second target area having a target ring;

FIG. 8A-2 schematically illustrates an embodiment of using at least one projection device coupled to a projectile device to project multiple optical reference points within a first target area that is closer than a second target area having a target ring;

FIG. 8A-3 schematically illustrates an embodiment of using at least one projection device coupled to a projectile device to project multiple optical reference points within a first target area that is farther than a second target area having a target ring;

FIGS. 14A-1, 14B-1, and 14C-1 schematically illustrate embodiments of different mounting methods for coupling at least one projection device to a projectile device;

FIGS. 14A-2, 14B-2, and 14C-2 schematically illustrate partially exploded views of the embodiments of FIGS. 14A-1, 14B-1, and 14C-1, respectively;

FIGS. 17A-1 and 17B-1 schematically illustrate embodiments of an aimable illumination source that may be coupled to a projection device;

FIGS. 17A-2 and 17B-2 schematically illustrate a partially exploded view of the aimable illumination source of FIGS. 17A-1 and 17B-1, respectively;

FIG. 24 depicts an effect of using two reference points in zeroing a projectile device;

FIG. 25 depicts an effect of using three parallel beams and their corresponding reference points in zeroing a projectile device;

FIG. 26 depicts an effect of using three diverging beams and their corresponding reference points in zeroing a projectile device;

FIG. 26A depicts an effect of using two parallel beams and a third beam orientated at an angle with the two parallel beams and the corresponding reference points of all three beams in zeroing a projectile device;

FIG. 26B depicts an effect of using three converging beams and their corresponding reference points in zeroing a projectile device;

FIG. 42 depicts a pre-printed target that is configured for used with pre-calibrating or zeroing a projectile device for a plurality of distances;

FIG. 43 depicts the use of a collimator for sharpening a beam;

Figure 1:
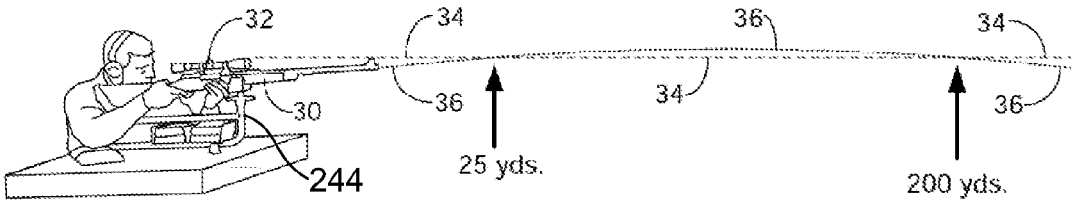
FIG. 1 schematically illustrates an example of a person aiming a rifle over a distance of one hundred yards using a scope.

It will be appreciated that for purposes of clarity and where deemed appropriate, reference numerals have been repeated in the figures to indicate corresponding features, and that the various elements in the drawings have not necessarily been drawn to scale in order to better show the features.

REFERENCE NUMERALS

30 rifle
32 scope
34 imaginary sight line
36 curved path
38 target ring
40 point of aim
42, 44 scope's crosshair
46 point of impact
48 horizontal offset
50 vertical offset
52 step of superimposing multiple reference points within a first target area
54 step of noting positions for at least two of the optical reference points
56 step of shooting a projectile from projectile device at a second target area while the positions of the at least two optical reference points are maintained to create a point of impact
58 step of adjusting the point of aim for the projectile device to correspond with the point of impact while the positions of the at least two optical references points are maintained
60 system
62 laser or superposition device
64 clamp
66 superposition device
68 rifle or projectile device
70 optical reference point or reference point
72 embodiment of superposition device
74A, 74B laser
76 embodiment of superposition device
78 illumination source
80 beam splitter
82 first light beam
84 second light beam
86 mirror
88A, 88B dot
90A, 90B end
92A, 92B end
94A, 94B outer corner
96A, 96B side
98 first target area
100 second target area
102 target ring
104 first target area
106 second target area
108 first target area
110 second target area
112 writing device
114 push pin
116 point of impact
118 point of aim
120 scope
122 target
124 first target area
126 pre-printed reference points
128 second target area
129 grid
130 target
132 first target area
134 adjustable reference points
136 optical reference points
138 alignment points
140 point of impact
142 point of aim
144 center of mass
146 system
148 level
150 system
152 activation switch
154 angular clamping device

156 projectile device
158 clamp
160 mounting rail
162 projection or superposition device
164 guide rail
166 aimable illumination source
168 first surface
170 first distance
172 point of aim
174 first spot
176 step of locking the aimable illumination source to maintain the coincidence with the point of aim at the first time
178 optional step of determining magnification and range settings at the first time for an aiming device coupled to the projectile device and used for the point of aim
180 optional step of recording the magnification and range settings
182 optional step of removing the aimable illumination source from the projectile device
184 optional step of determining the first distance
186 optional step of recording the first distance
188 optional step of re-coupling the locked aimable illumination source to the projectile device at the repeatable location, on a second surface located substantially at the first distance
190 step of, at second time, shining a second spot from the locked aimable illumination source, coupled t the projectile device at the repeatable location, on a second surface located substantially at the first distance
192 second spot
194 second surface
196 optional step of setting the magnification and range settings of the aiming device to the determined magnification and range settings
198 step of adjusting the point of aim of the projectile device if necessary so that the point of aim coincides with the second spot from the locked aimable illumination source
200 point of aim
202 aimable illumination source
203 stop
204 star nuts
206 index
208 group of points of impact
210 centroid of group of points of impact
212 rubberized sleeve
214 superposition device pitch angle adjuster
216 beam for superposing reference point
218 proximal plane
220 distal plane
222 projection of crosshairs 42, 44
224 alignment point in scope
226 longitudinal axis of superposition device
228 longitudinal axis of sleeve
230 adjustable beam splitter
232 adjustable mirror
234 reflective reference point
236 collimator
238 collimated footprint
240 uncollimated footprint
242 sight aid
244 lead sled
246, 248 sight aid
250 position-adjustable indicator
252 projected image or supplementary sight alignment indicator
254 housing
256 view point of a user's eye
258 projection device
260 objective lens
262 ocular lens
264 primary sight alignment indicator
266 projection plane
268 hinge
270 image erecting optics
272 reticle
274 crosshairs
276 optical axis

DETAILED DESCRIPTION

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The term "marking beam" or "beam" is used herein to mean (1) a beam emanating from a superposition device, the beam is used in producing a dot in a first target area where the dot is to be marked as a reference point in a first target area, or (2) a beam emanating from a superposition device, the beam is used in superimposing a reference point that is pre-printed or otherwise made available in a first target area.

In one embodiment, the present projectile device zeroing system which takes advantage of a collimated superposition device coupled with at least one reference point, eliminates inaccuracies involved in zeroing a projectile device that are caused by uncertainties in superposing a reference point as a user can gauge the concentricity of a collimated footprint of a superposing beam more easily with respect to the reference point.

Compared with a conventional zeroing method, the present method eliminates the use of multiple rounds, reduces the amount of time taken, and increases the effectiveness in zeroing a projectile device.

Figure 3:
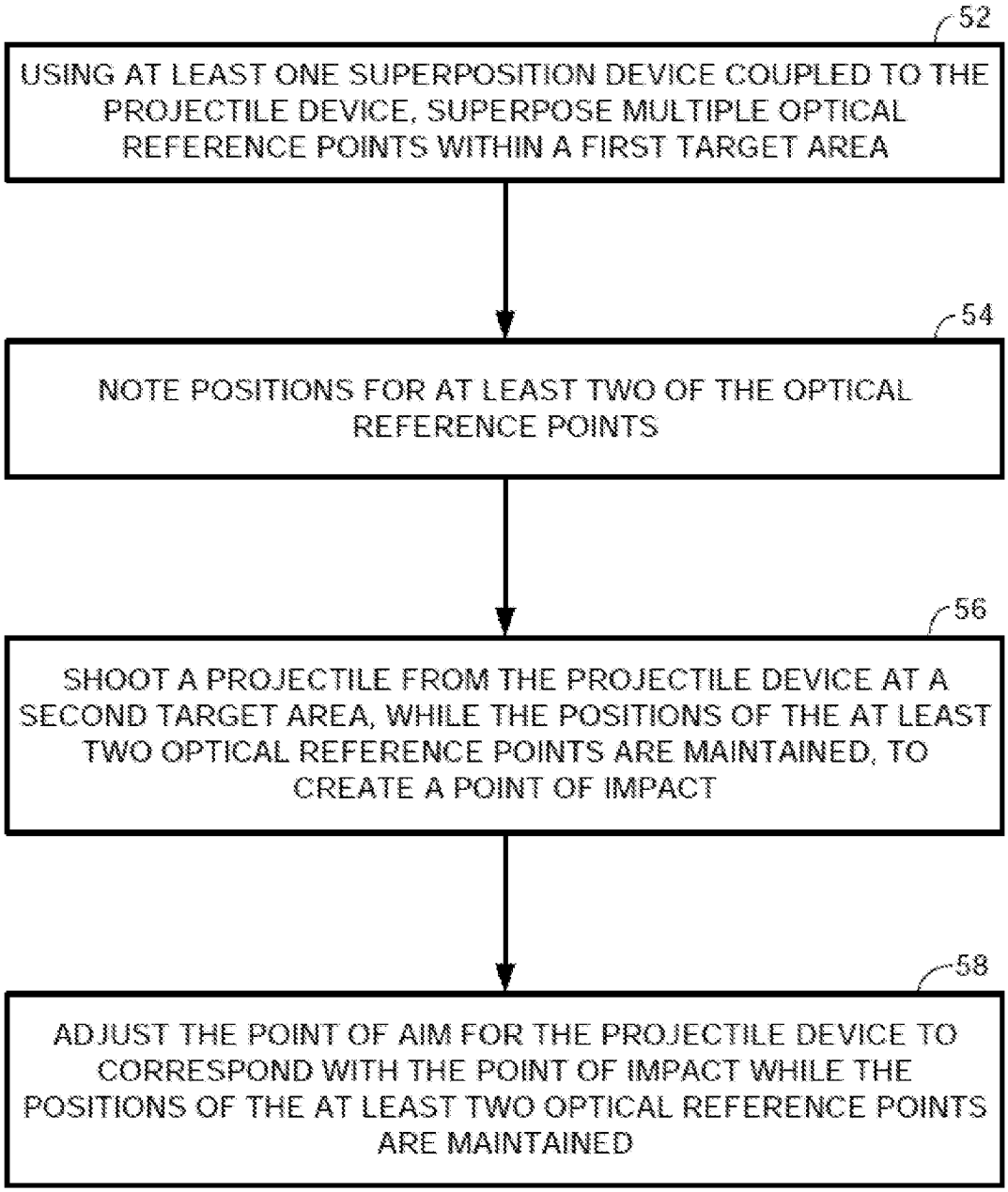
FIG. 3 illustrates one embodiment of a method of aligning a point of aim with a point of impact for a projectile device.

FIG. 3 illustrates one embodiment of a method of aligning a point of aim with a point of impact for a projectile device. A projectile device may include, but is not limited to a rifle, a pistol, a gun, a shotgun, a firearm, a BB gun, an air gun, a pellet gun, a bow, a cannon, or any weapon from which a projectile is launched explosively, pneumatically, or by stored tension. As mentioned previously, for convenience, the projectile device will often be discussed in terms of a rifle within this specification. However, it should be understood that the scope of a projectile device is much larger than just a rifle and is intended to include, but not be limited to, all listed examples of projectile devices, their equivalents, and alternates.

In step 52, using at least one superposition device coupled to the projectile device, multiple optical reference points or reference points are superposed within a first target area. In some embodiments, the at least one superposition device may include at least one illumination source such as, but not limited to a laser. In the case where the at least one superposition device coupled to the projectile device is at least one illuminated light source, the at least one illuminated light source can project multiple optical reference points onto the first target area as visible light spots and/or shapes shined onto the first target area. In other embodiments, the at least one superposition device may include scope features (multiple optical reference points) which are visible over (superposed) on the first target area when looking through the scope. Such embodiments will be discussed further in more detail later in this specification.

In step 54, positions for at least two of the optical reference points are noted. In the case of illuminated optical reference points, the optical reference points may be marked on the first target area with items such as, but not limited to a marker, a writing device, a push pin, or a sticker. Alternatively, the optical reference points may be noted by aligning the illuminated optical reference points over pre-printed indicators in the first target area. Similarly, in the case of embodiments where the at least two optical reference points come from scope features which may be superposed on a target area by looking through a scope, the optical reference points may be noted by aligning the scope's optical reference points over the pre-printed indicators in the first target area.

In step 56, a projectile is shot from the projectile device at a second target area, while the positions of the at least two optical reference points are maintained, to create the point of impact. In some embodiments, the first target area may include the second target area. On other embodiments, the first target area and the second target area may be located in different locations and not even physically connected to one another. This will be discussed in more detail later in this specification. Projectiles may include, but are not limited to a bullet, multiple shot, a BB, a pellet, and an arrow. In step 58, the point of aim for the projectile device is adjusted to correspond with the point of impact while the positions of the at least two optical reference points are maintained on their noted locations. The point of aim for a projectile device is determined, in part by the aiming device used with the projectile device. Some examples of aiming devices include, but are not limited to a scope, an iron sight, a dot sight, a holographic sight, a shotgun sight, a bead sight, and a ramp sight. Once the point of aim for the projectile device is adjusted to correspond with the point of impact, while the positions of the at least two optical reference points are maintained on their noted locations, the projectile device will be properly zeroed (the point of aim will be aligned with the point of impact) with only a single shot.

Without being tied to a particular theory, this method relies on triangulation, using the point of impact and the multiple optical reference points to obtain a minimum of three points of reference to ensure that when the point of aim is moved that other variables such as distance from target and rifle cant (tipping) are minimized.

Figure 4:
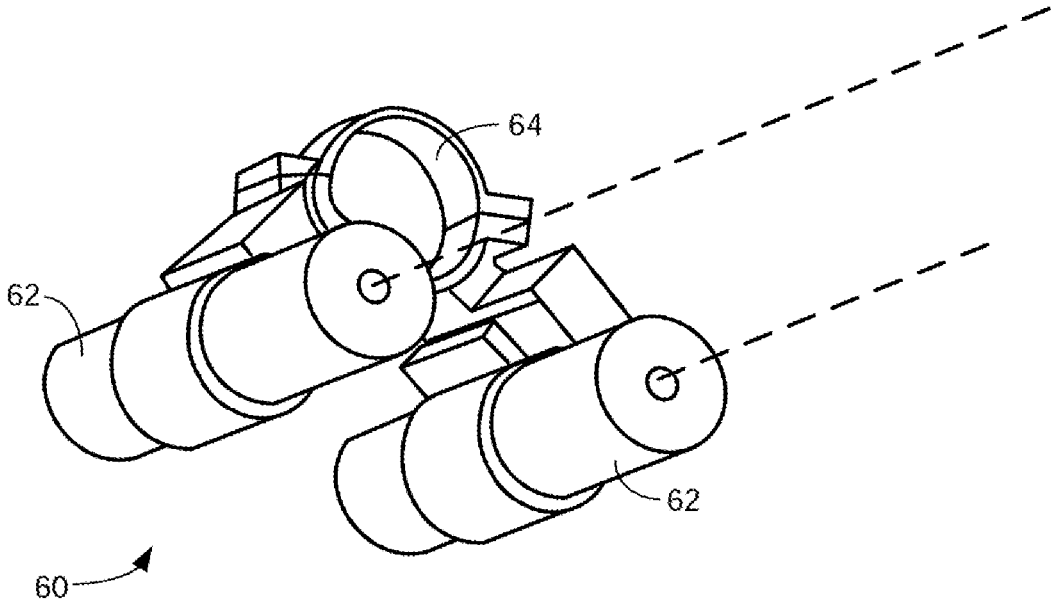
FIG. 4 schematically illustrates one embodiment of a system for aligning a point of aim with a point of impact for a projectile device.

FIG. 4 schematically illustrates one embodiment of a system 60 for aligning a point of aim with a point of impact for a projectile device. The system 60 has at least one superposition device configured to be coupled to the projectile device, and to superpose multiple optical reference points within a target area. For the embodiment of FIG. 4, the system 60 has two superposition devices 62 (lasers in this example) which may be coupled to a rifle barrel via clamp 64. There are many types of connections known to those skilled in the art which would allow the coupling of the lasers 62 to a rifle barrel. As just some non-limiting examples, rounded, oval, or angled screw-on clamps may be used. Other embodiments may have clamps which are cantilevered to enable quick attachment and removal of the system 60. Still other embodiments may make use of existing or custom detents, tapped holes, threaded posts, adhesives, interchangeable mounting brackets, and/or the like, as well as other mounting positions on the projectile device.

Figure 5:
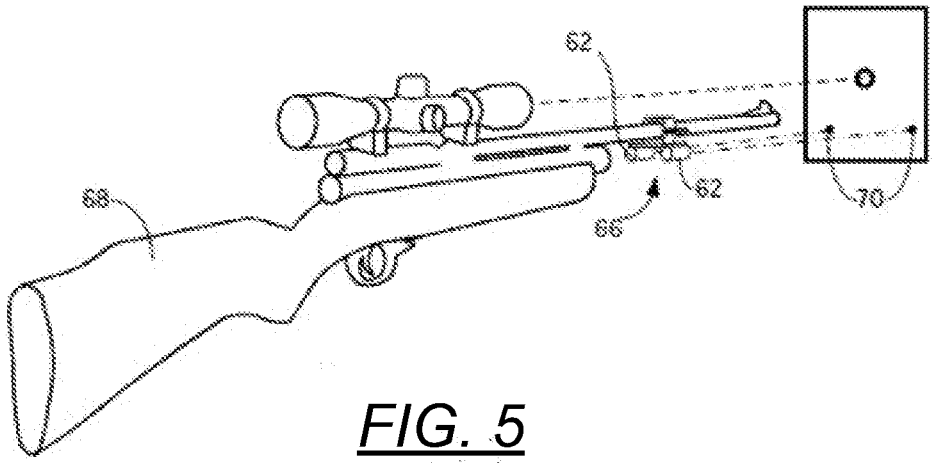
FIG. 5 schematically illustrates one embodiment of a system, coupled to a rifle, for aligning a point of aim with a point of impact.

FIG. 5 schematically illustrates one embodiment of a system 66, coupled to a rifle 68, for aligning a point of aim with a point of impact. As can be seen in this view, the lasers 62 may be activated to create multiple optical reference points 70 on a target area. In some embodiments, it may be desirable to have the lasers diverge so that the spacing of the gap between the optical reference points 70 has a relation to the distance from the target. In some embodiments, this amount of laser divergence may be adjustable.

Figure 6A:
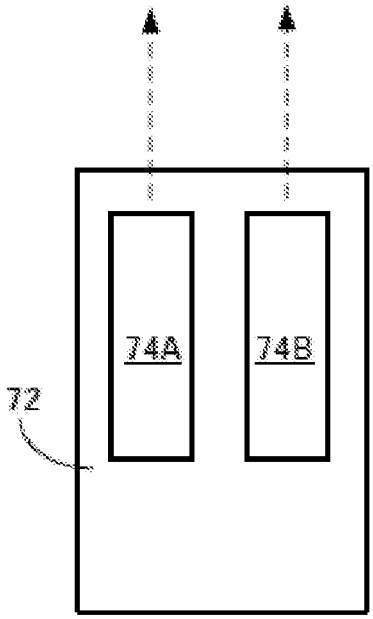
FIGS. 6A and 6B schematically illustrate embodiments of projection devices for projecting multiple optical reference points.
Figure 6B:
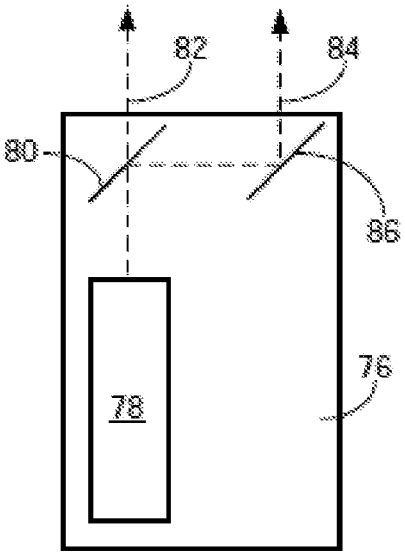

FIGS. 6A and 6B schematically illustrate embodiments of superposition devices for superposing multiple optical reference points. The superposition device embodiment 72 of FIG. 6A has two illumination sources, in this example lasers 74A and 74B. Other embodiments may be like superposition device embodiment 76 of FIG. 6B which has one illumination source 78 sending light through a beam splitter 80 to create a first light beam 82 which will correspond to a first optical reference point. The beam splitter 80 also creates a second light beam 84 which exits the superposition device 76 after being redirected by mirror 86. The superposition device embodiments of FIGS. 6A and 6B are merely illustrative that the superposition devices may have many different configurations. Those skilled in the optical arts may select from any of a number of superposition device designs, provided the multiple optical reference points are visibly superposed at a desired target distance or distances.

Figure 7A:
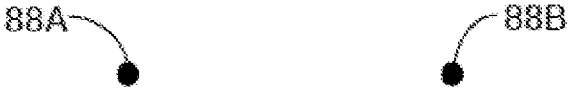
FIGS. 7A-7E illustrate embodiments of multiple optical reference points.
Figure 7B:
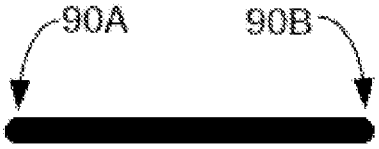
Figure 7C:
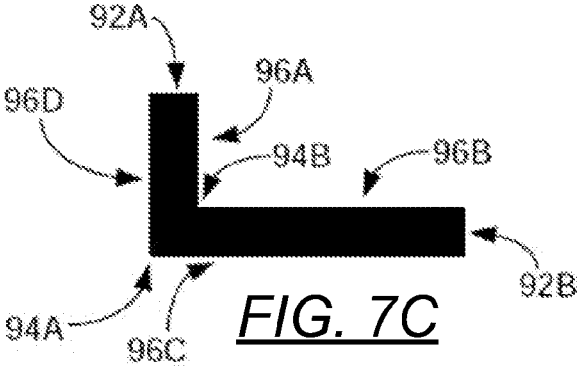
Figure 7D:
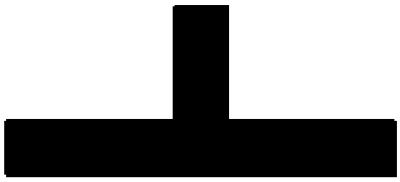
Figure 7E:
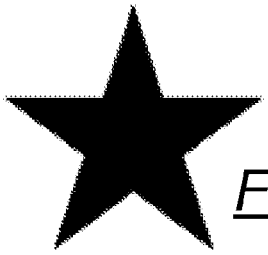

FIGS. 7A-7E illustrate a non-exhaustive set of embodiments of multiple optical reference points created by one or more superposition devices. The embodiment of FIG. 7A is used often throughout this specification and includes two dots 88A and 88B as its multiple optical reference points. The embodiment of FIG. 7B has multiple ends 90A and 90B which could be used as multiple optical reference points. The embodiment of FIG. 7C has ends 92A and 92B, inner and outer corners 94A and 94B, sides 96A, 96B, 96C, and 96D which may be used in parts or in whole a multiple optical reference points. FIGS. 7D and 7E illustrate two other embodiments of shapes which could be created by one or more superposition devices, such shapes having multiple sides and corners with which to create optical reference points.

Figures 1, 8A:
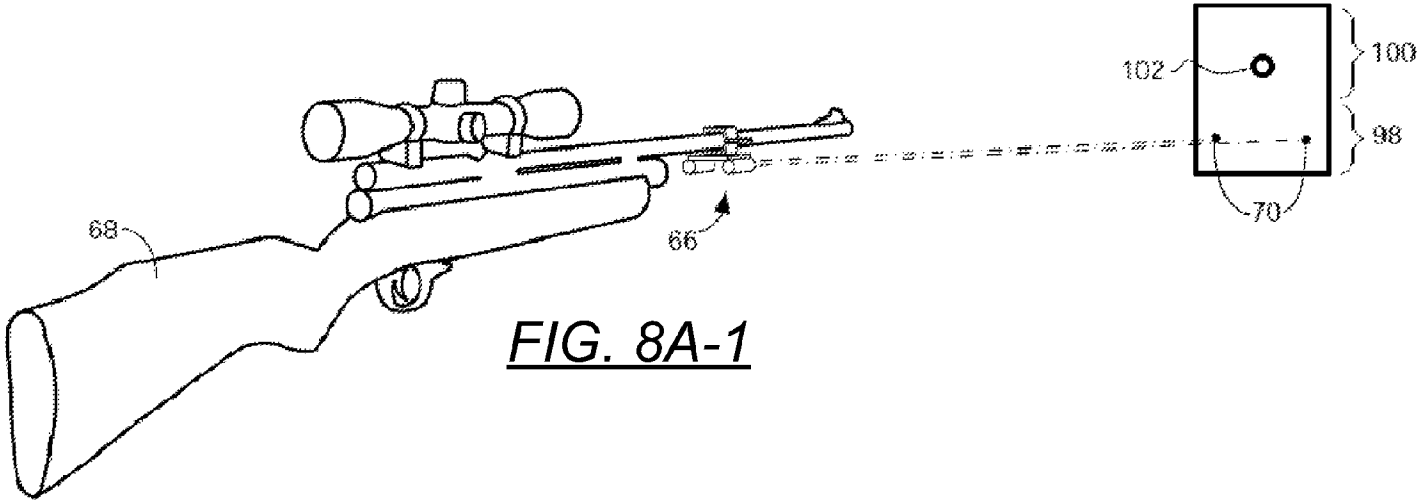
Figures 2, 8A:
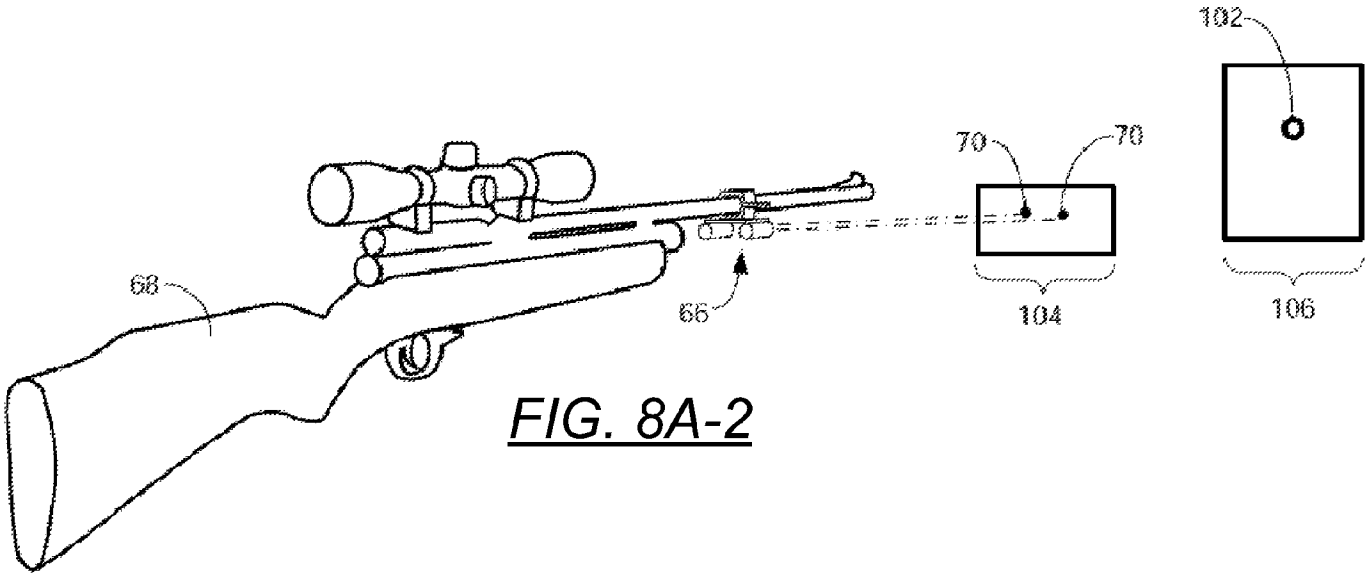
Figures 3, 8A:
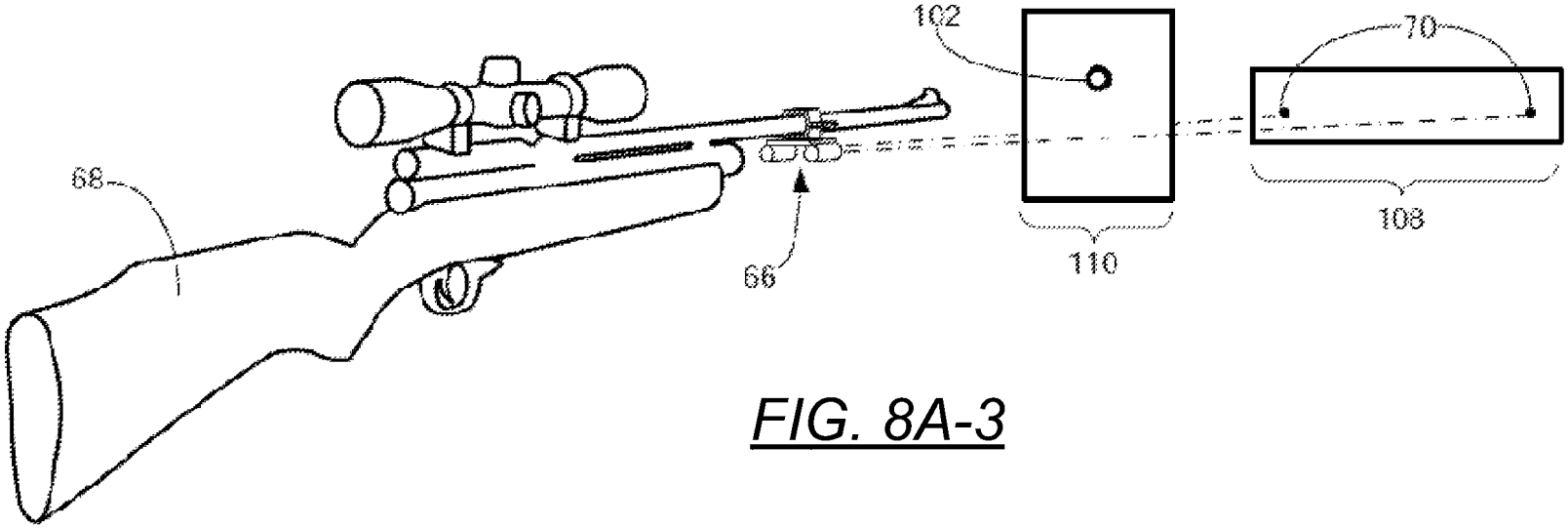

As mentioned briefly before, the at least one superposition device may project multiple optical reference points onto a first target area. This first target area may be in a variety of locations relative to a second target area where the point of aim will occur. For example, FIG. 8A-1 schematically illustrates an embodiment of using at least one superposition device 66 coupled to a rifle 68 to superpose (project in this embodiment) multiple optical reference points 70 within a first target area 98 that coincides with a second target area 100 having a target ring 102. In this example, the first target area 98 and the second target area 100 are on the same paper target.

Figure 2:
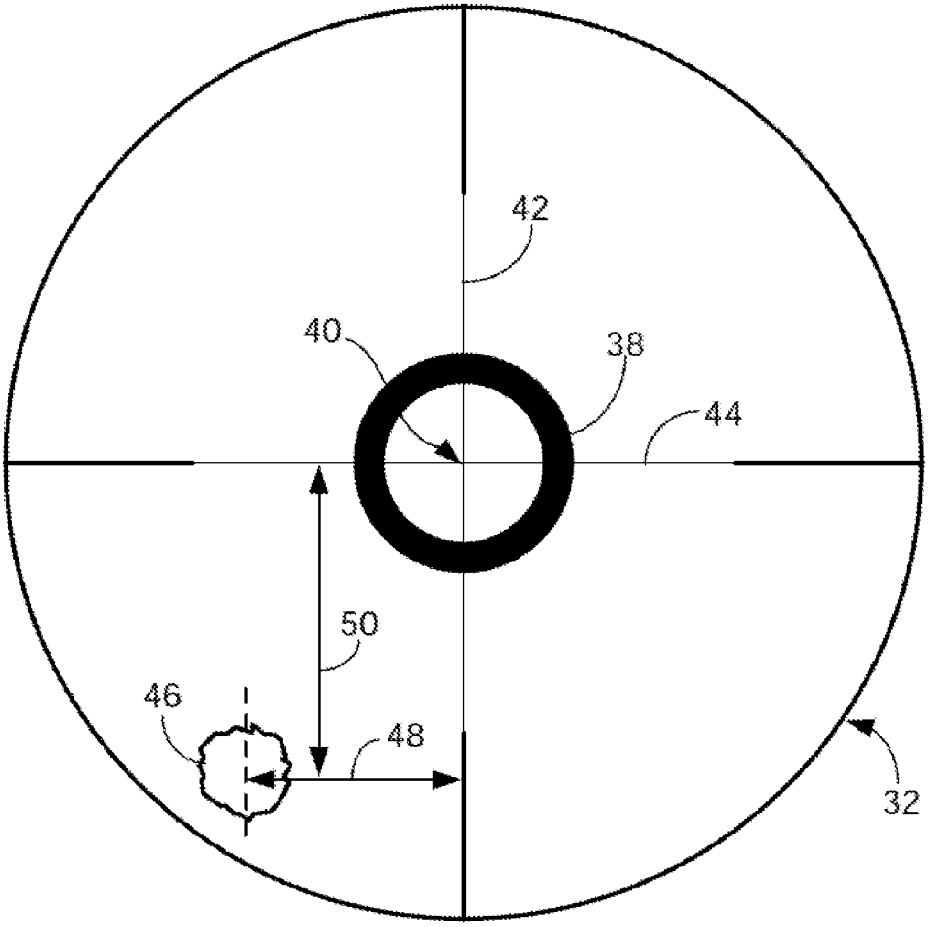
FIG. 2 schematically illustrates one example of a view of a target ring through a scope, where a point of impact is not properly aligned with a point of aim.

By comparison, FIG. 8A-2 schematically illustrates an embodiment of using at least one superposition 66 device coupled to a projectile device 68 to superpose multiple optical reference points 70 within a first target area 104 that is closer than a second target area 106 having a target ring 102. This configuration may be useful for enabling embodiments which use lower power lasers to superpose optical reference points, since the laser or lasers would not need to be powerful enough to be visible at the second target area distance.

Furthermore, FIG. 8A-3 schematically illustrates an embodiment of using at least one superposition device 66 coupled to a projectile device 68 to superpose multiple optical reference points 70 within a first target area 108 that is farther than a second target area 110 having a target ring 102. The three scenarios of FIGS. 8A-1, 8A-2, and 8A-3 are all compatible with the methods disclosed herein. For the sake of simplicity, therefore, the remaining discussion will use the situation of FIG. 8A-1 in the following discussions.

Figure 8B:
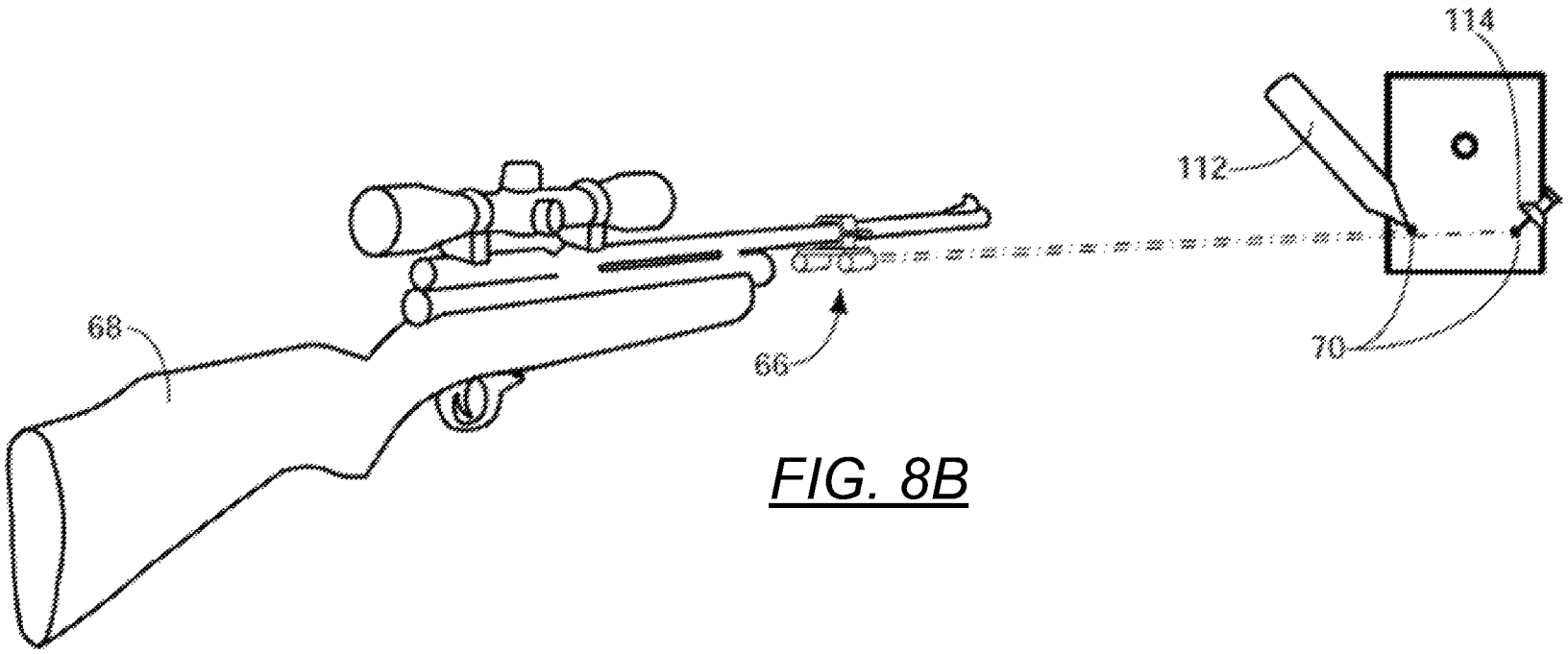
FIG. 8B schematically illustrates one embodiment of noting positions for at least two of the optical reference points.

FIG. 8B schematically illustrates one embodiment of noting positions for at least two of the optical reference points. As some non-limiting examples, the positions for the two optical reference points 70 may be noted with a writing device 112 or with a device like a push pin 114.

Figure 8C:
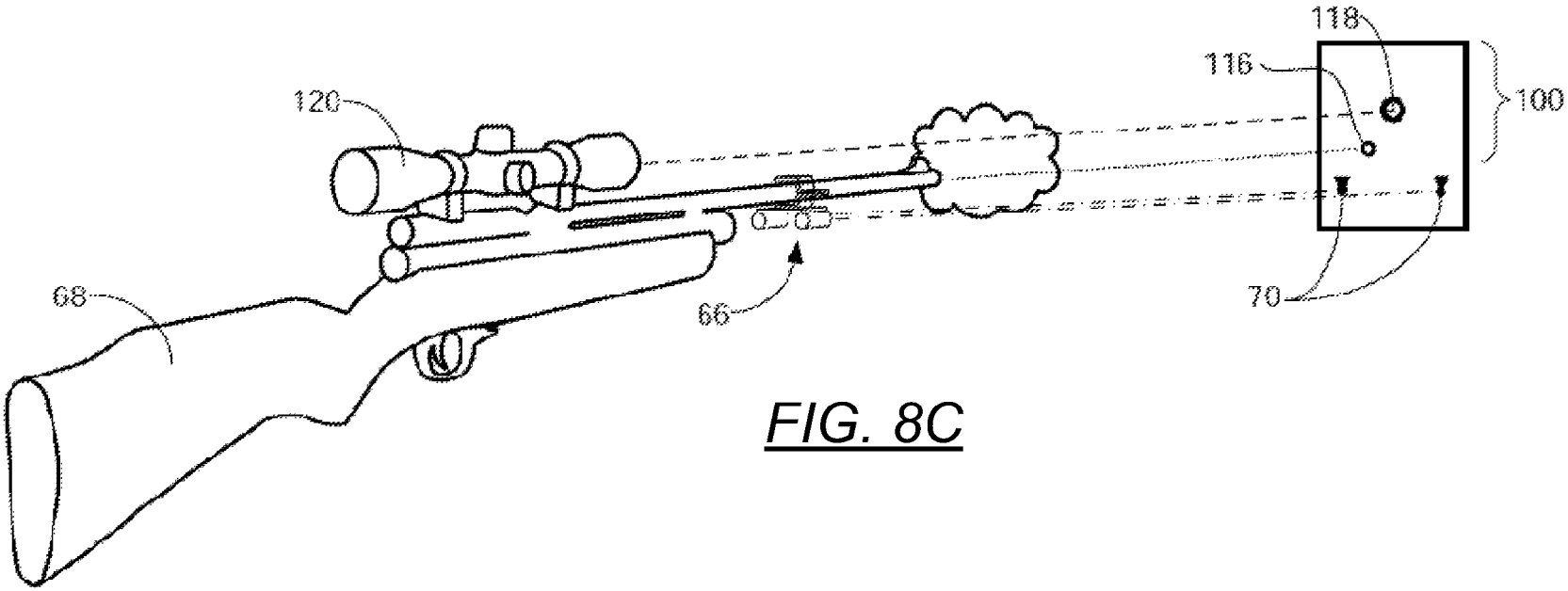
FIG. 8C schematically illustrates an embodiment of shooting a projectile from the projectile device at a second target area, while the positions of the at least two optical reference points are maintained, to create a point of impact.

FIG. 8C schematically illustrates an embodiment of shooting a projectile from the projectile device 68 at a second target area 100, while the positions of the at least two optical reference points 70 are maintained, to create a point of impact 116. A point of aim 118 also exists as determined by sighting down the scope 120 towards the target. While it is not necessary to establish the point of aim 118 prior to noting the multiple optical reference points 70, if this is done, then the point of aim can start off directed towards a desired point of aim.

Figure 8D:
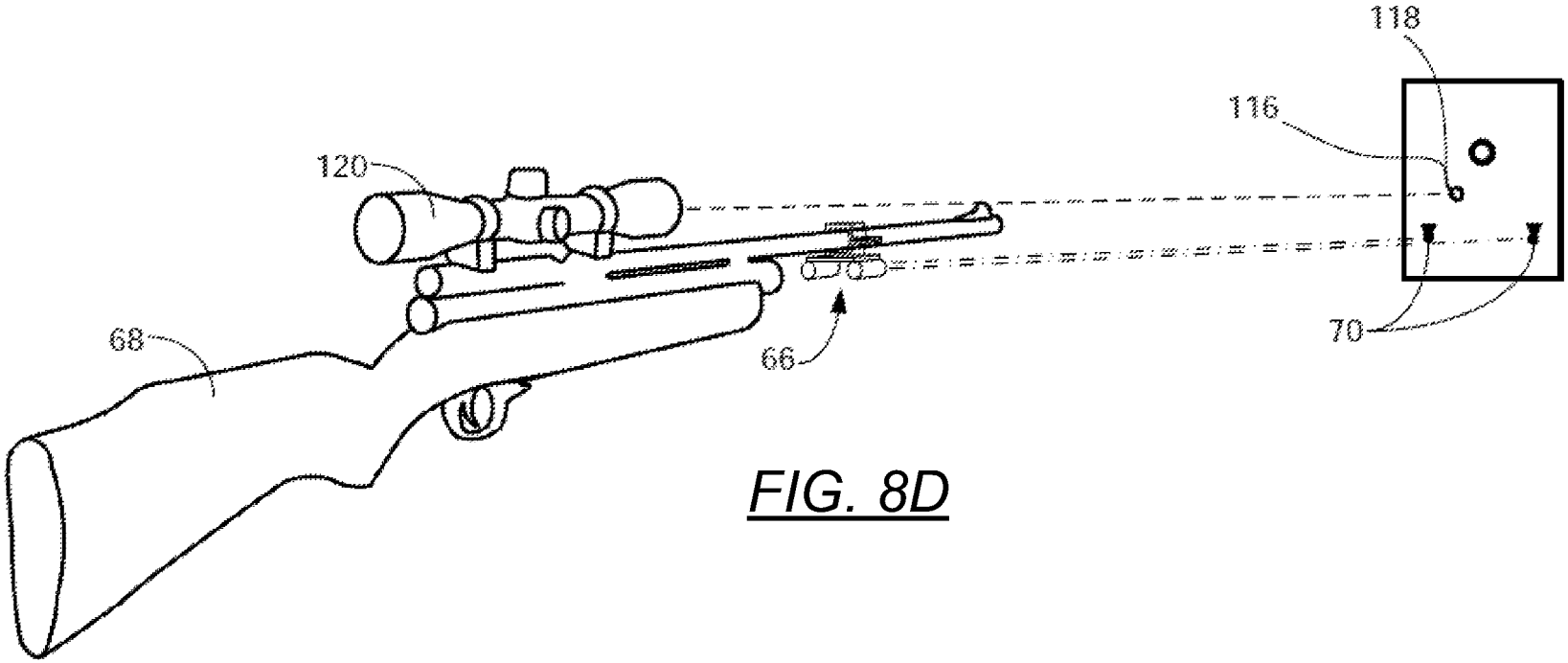
FIG. 8D schematically illustrates an embodiment of adjusting the point of aim for the projectile device to correspond with the point of impact while the positions of the at least two optical reference points are maintained.
Figure 9:
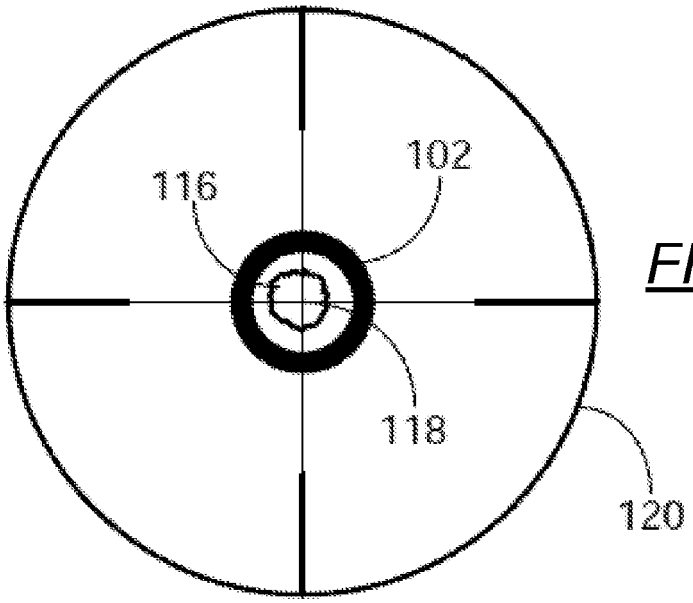
FIG. 9 schematically illustrates one example of a view of a target ring through a scope, where a point of impact is properly aligned with a point of aim.

FIG. 8D schematically illustrates an embodiment of adjusting the point of aim 118 for the projectile device 68 to correspond with the point of impact 116 while the positions of the at least two optical reference points 70 are maintained. The method used to adjust the point of aim 118 for the projectile device 68 will depend on the aiming device being used. The beauty of this method, however, is that rulers are not needed to measure offsets and clicks do not need to be counted. The adjustments available simply need to be turned or otherwise adjusted until the point of aim 118 moves over the point of impact. At this point, the projectile device is zeroed, after having only fired a single projectile round. FIG. 9 schematically illustrates one example of a view of a target ring 102 through a scope 120, where a point of impact 116 is properly aligned with a point of aim 118 following use of the described method.

Figure 10A:
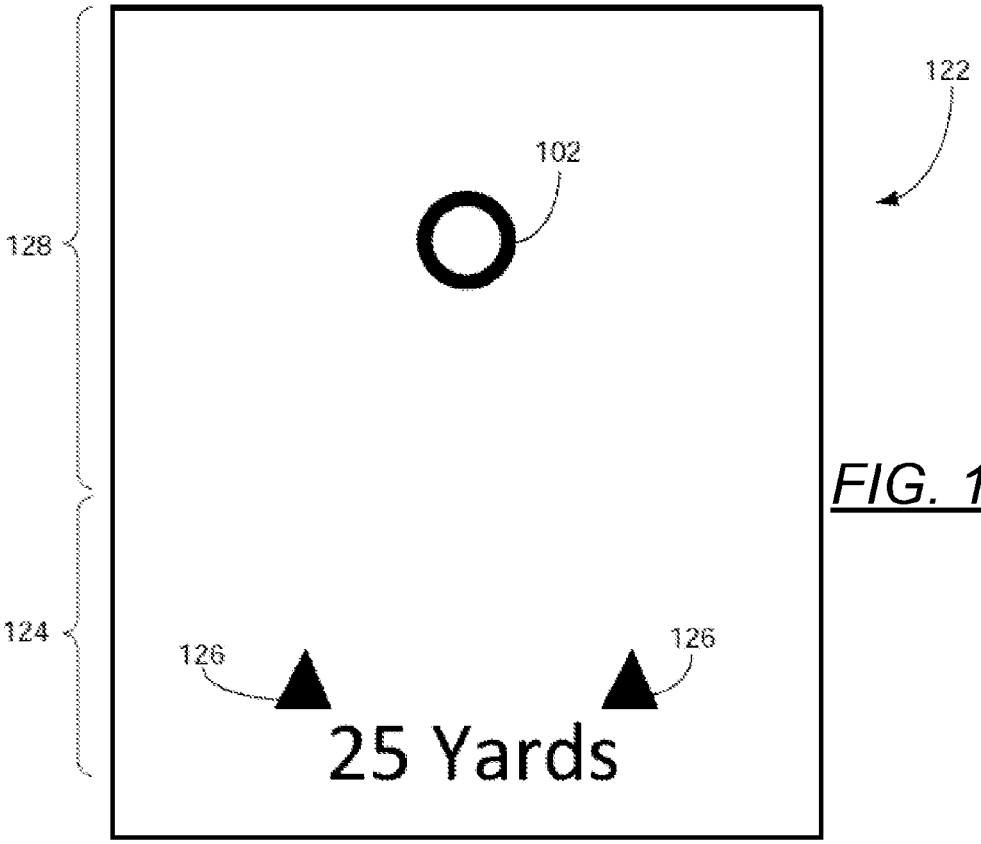
FIG. 10A schematically illustrates one embodiment of a target having a first target area with pre-printed reference points corresponding to desired positions for optical reference points. This target embodiment also has a second target area with a pre-printed target ring.
Figure 10B:
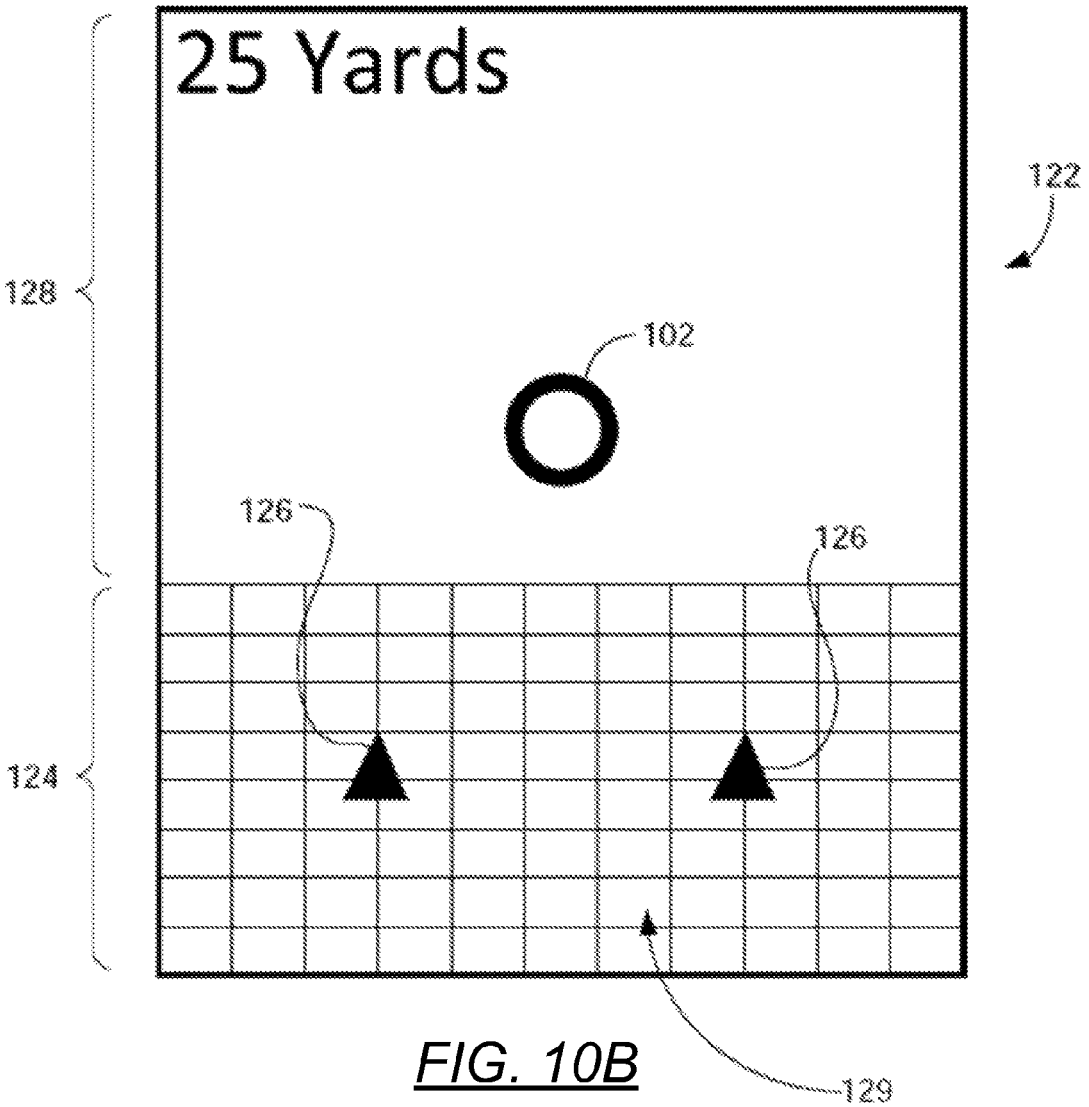
FIG. 10B schematically illustrates another embodiment of a target having a first target area with pre-printed reference points corresponding to desired positions for optical reference points. This target embodiment also has a second target area with a preprinted target ring.
Figure 10C:
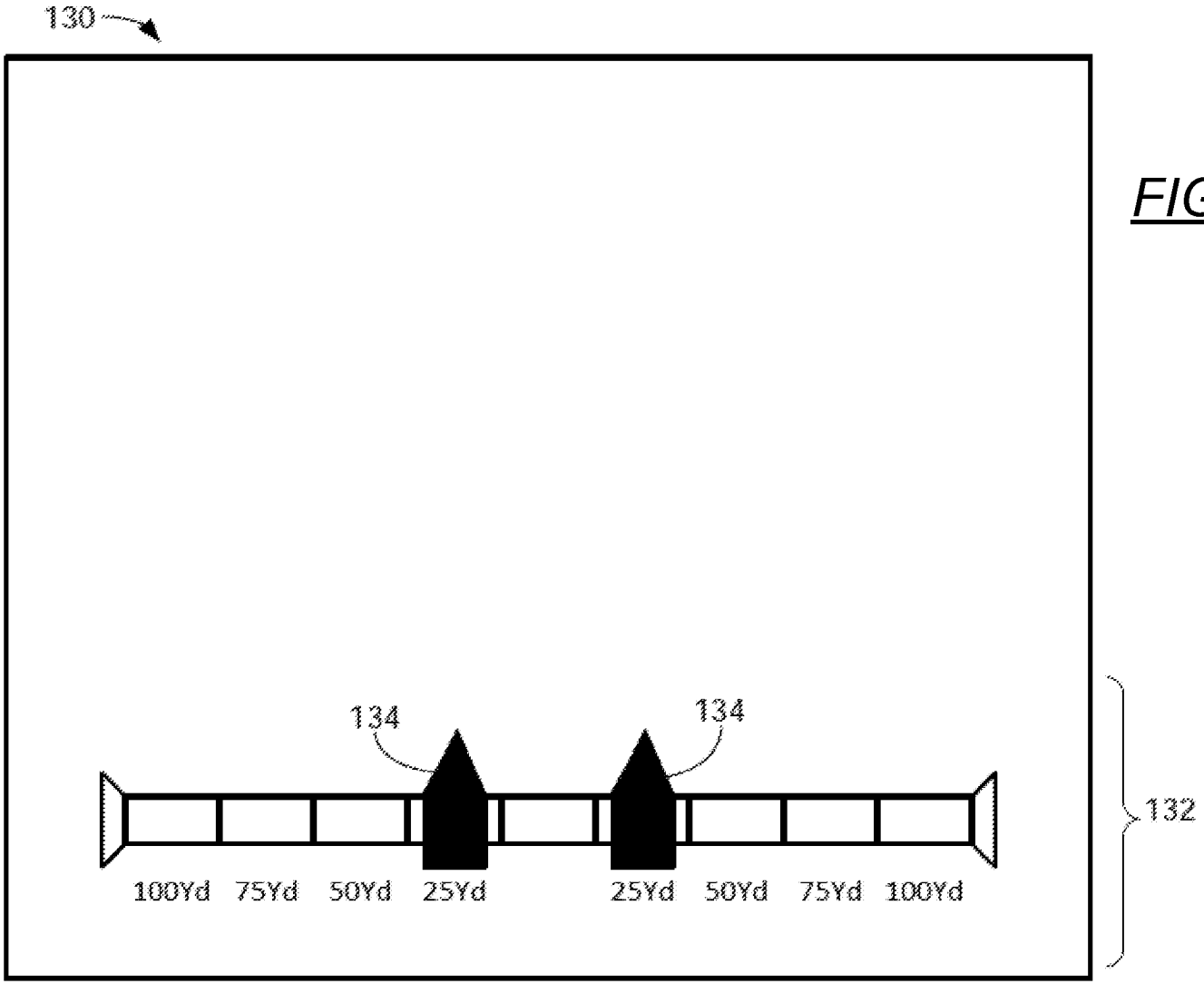
FIG. 10C schematically illustrates a further embodiment of a target having a first target area with adjustable reference points corresponding to desired positions for optical reference points. This target embodiment also has a second target area on which a target may be drawn or hung.

As an alternative to noting the locations of the multiple optical reference points with a marker or pins, FIG. 10A schematically illustrates one embodiment of a target 122 having a first target area 124 with pre-printed reference points 126 corresponding to desired positions for optical reference points. Targets 122 may be made with the pre-printed reference points 126 spaced apart for particular zeroing distances, such as, but not limited to one or more of 25 yds., 50 yds., and 100 yds. By using such a preprinted target 122, the user can complete the zeroing process without need for the user or an assistant to walk out to the target during the zeroing process. The user would need to be at the proper distance from the target, but that distance can only be achieved when the optical reference points align with the pre-printed reference points 126. Alignment of the optical reference points with the pre-printed reference points 126 would be another way of noting positions for the at least two optical reference points. This target embodiment also has a second target area 128 with a pre-printed target ring 102. Although a simple target ring 102 is illustrated in this embodiment, other embodiments may include a variety of targets as desired. Alternatively, no target may be included in the second target area 128. This would allow the user to draw or hang up his own additional target. FIG. 10B schematically illustrates another embodiment of a target 122 having a first target area 124 with pre-printed reference points 126 corresponding to desired positions for optical reference points. The embodiment of FIG. 10B also includes a grid 129 in the first target area 124. The grid 129 has horizontal lines which can be used as an assistance for leveling the target 122. The horizontal and vertical lines of the grid 129 also may provide alignment guides for a user when aligning the optical reference points with the pre-printed target references. FIG. 10C schematically illustrates a further embodiment of a target 130 having a first target area 132 with adjustable reference points 134 corresponding to desired positions for optical reference points. The adjustable reference points 134 enable a single target with pre-printed reference points to be used at multiple distances by selecting the appropriate reference point spacing on the target 130. This target embodiment also has a second target area on which a target may be drawn or hung.

As mentioned previously, superposing multiple optical reference points within a target area does not have to be done with an illumination device. Alternatively, this may be accomplished by superposing multiple optical references visible in the scope optical path within the target area. Then, the step of noting positions for at least two of the optical reference points may be accomplished by aligning the multiple optical references over predetermined marks in the target area. For example, consider FIG. 11A which schematically illustrates one embodiment of a view through a projectile device scope, the scope having multiple optical reference points 136 thereon which may be superposed onto a target area. In such embodiments, optical reference points visible in the scope may be etched on a portion of glass or other transparent or transmissive material in the optical path. Alternatively or additionally, the optical reference points may be constantly or selectively illuminated in one or more colors. In some embodiments, a spacing between the multiple optical reference points may be adjusted.

Figure 11A:
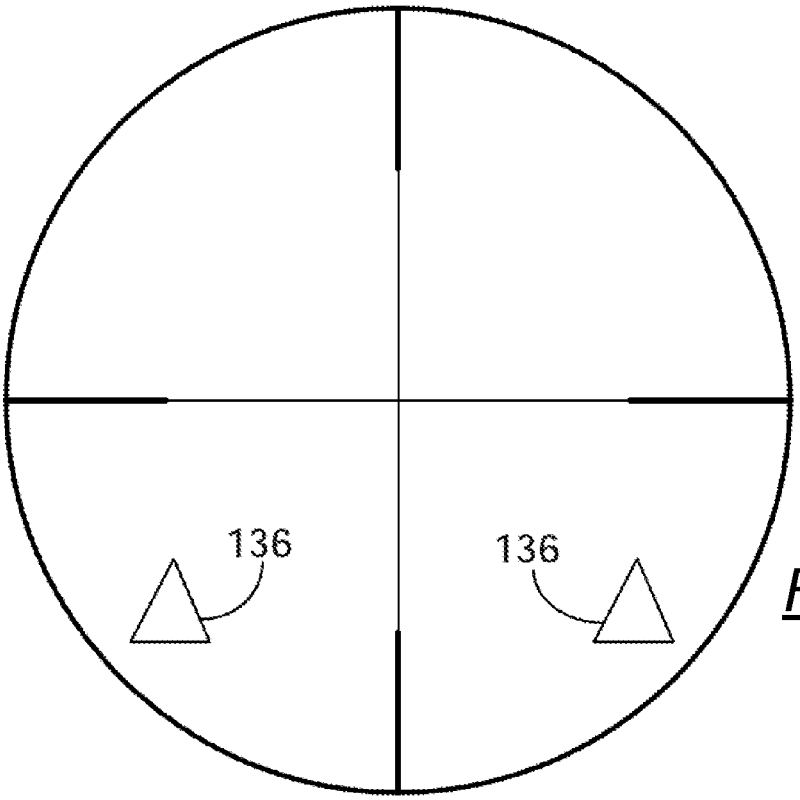
FIG. 11A schematically illustrates one embodiment of a view through a projectile device scope, the scope having multiple optical reference points thereon which may be projected onto a target area by being superimposed on the scope's image.
Figure 11B:
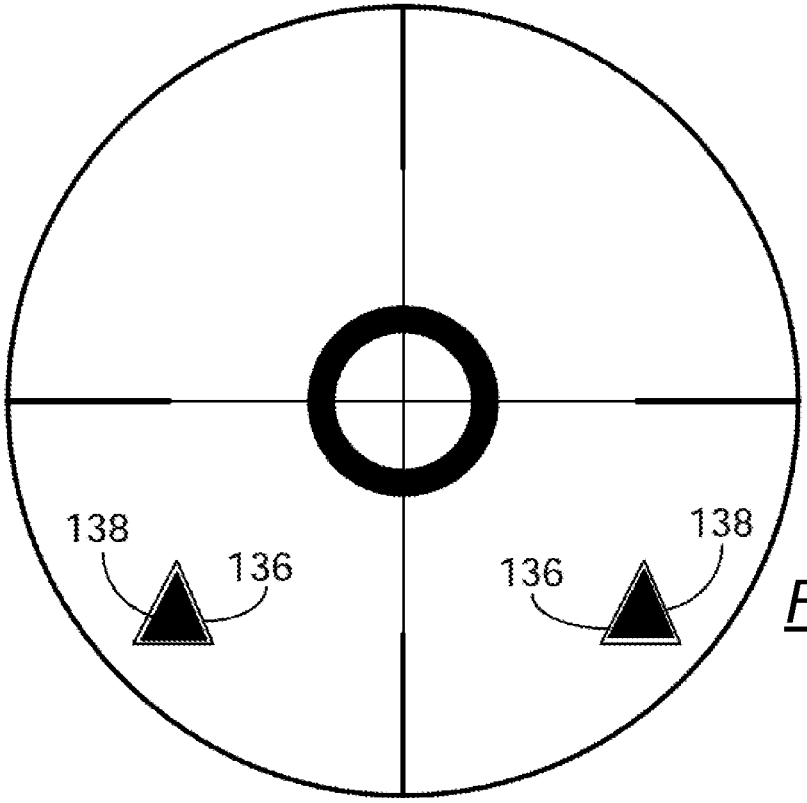
FIG. 11B schematically illustrates one embodiment of a view through the projectile device scope of FIG. 11A, wherein the multiple optical reference points of the embodiment of FIG. 11A are projected onto a first target area through superimposition of the scope's optical reference points onto multiple alignment points within the first target area.

FIG. 11B schematically illustrates one embodiment of a view through the projectile device scope of FIG. 11A, wherein the multiple optical reference points of the embodiment of FIG. 11A are superposed onto a first target area through superposition of the scope's optical reference points 136 onto multiple alignment points 138 within the first target area.

Figure 11C:
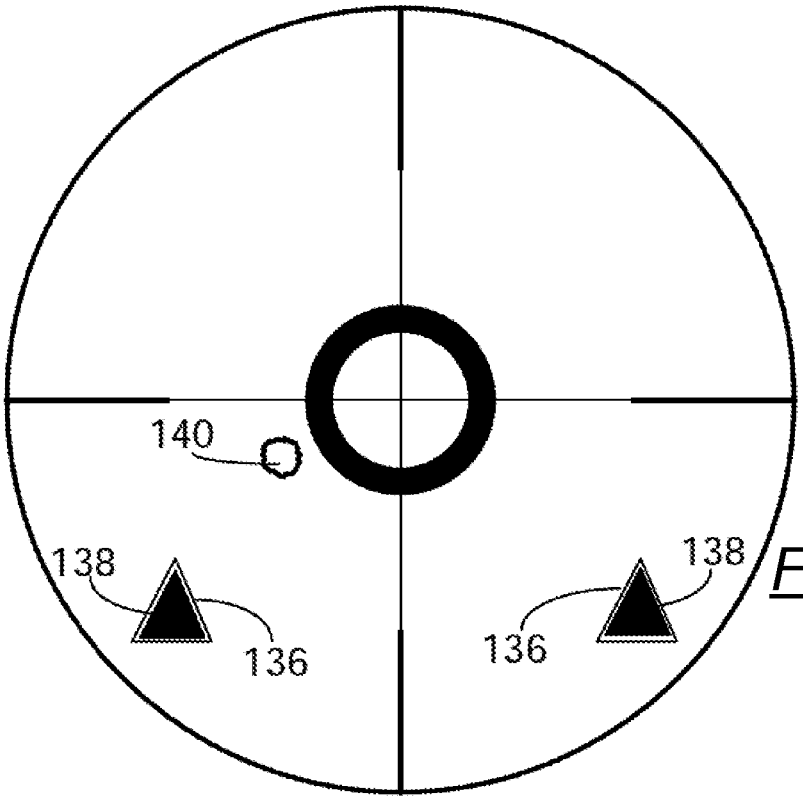
FIG. 11C schematically illustrates an example of a view through the projectile device scope of FIG. 11B, wherein a projectile has been shot from the projectile device at a second target area while the positions of the at least two optical reference points are maintained to create a point of impact.

FIG. 11C schematically illustrates an example of a view through the projectile device scope of FIG. 11B, wherein a projectile has been shot from the projectile device at a second target area. while the positions of the at least two optical reference points 136 are maintained on the alignment points 138 to create a point of impact 140.

Figure 11D:
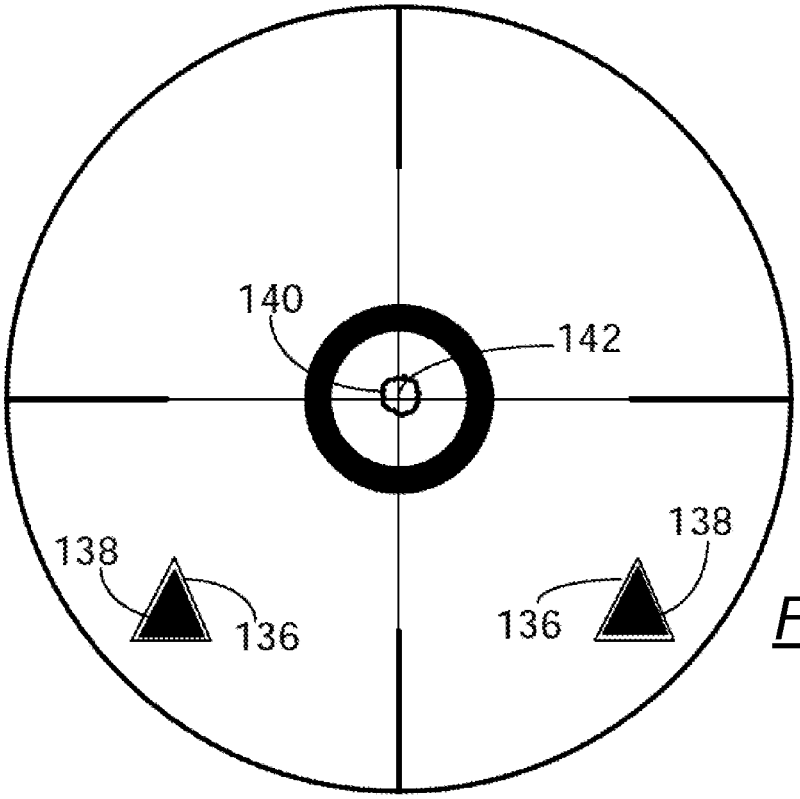
FIG. 11D schematically illustrates an example of a view through the projectile device scope of FIG. 11C, wherein the point of aim for the projectile device has been adjusted to correspond with the point of impact while the position of the at least two optical reference points are maintained.

FIG. 11D schematically illustrates an example of a view through the projectile device scope of FIG. 11C, wherein the point of aim 142 for the projectile device has been adjusted to correspond with the point of impact 140 while the position of the at least two optical reference points 136 are maintained.

Figure 12:
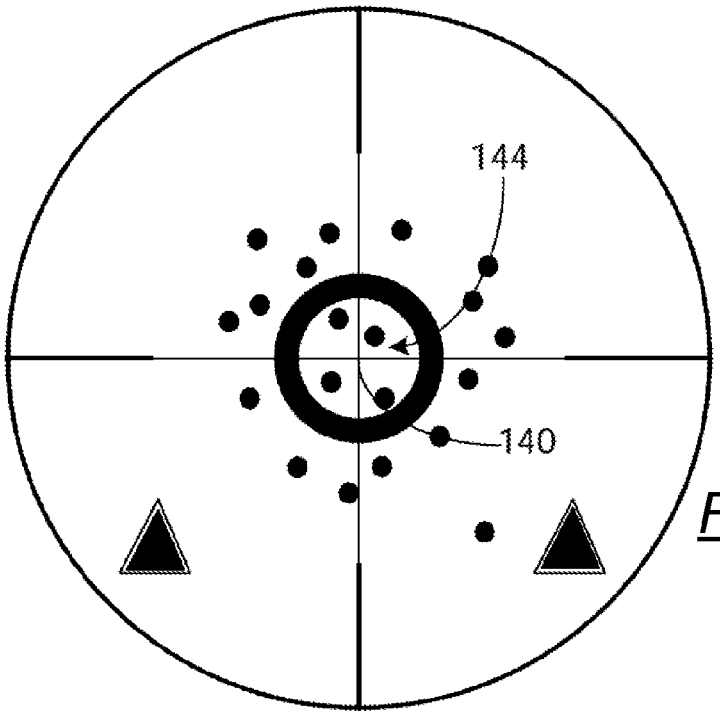
FIG. 12 schematically illustrates that the processes can be also be applied with shotgun projectile devices.

The described methods herein may be used with buckshot projectiles by treating a buckshot pattern center of mass 144 as a single point of impact which can then be aligned with a point of aim 140 as schematically illustrated in FIG. 12.

Figure 13A:
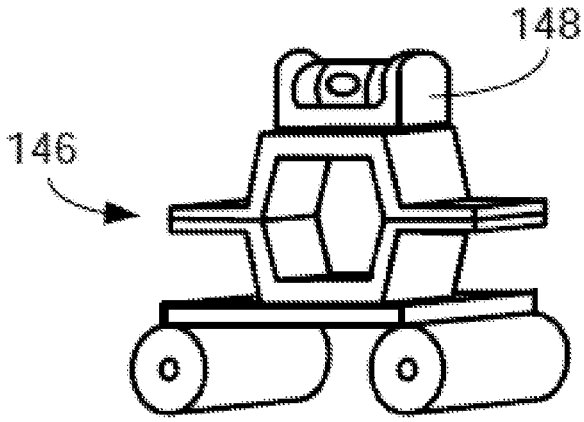
FIG. 13A schematically illustrates an embodiment of a system for aligning a point of aim with a point of impact for a projectile device, wherein the embodiment includes or is fashioned to support a level.

The methods and systems for aligning a point of aim with a point of impact disclosed herein are compatible with a variety of accessories. For example, FIG. 13A schematically illustrates an embodiment of a system 146 for aligning a point of aim with a point of impact for a projectile device, wherein the embodiment includes or is fashioned to support a level 148. The level 148 may be useful for helping a shooter to avoid canting his projectile device. This may be especially helpful in embodiments where the user is marking the optical reference points with a marker or a pen. Some embodiments can avoid the need for a level on the system coupled to the projectile device if pre-printed alignment points are hung level with each other on the target.

Figure 13B:
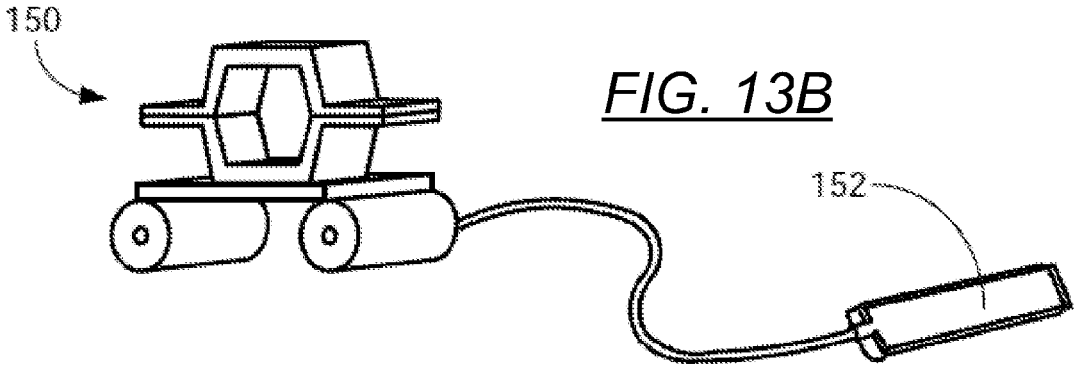
FIG. 13B schematically illustrates an embodiment of a system for aligning a point of aim with a point of impact for a projectile device, wherein the embodiment includes or is fashioned to receive a remote activation switch for the at least one projection device.

As another non-exhaustive example of an accessory which is compatible with the systems and methods disclosed herein, FIG. 13B schematically illustrates an embodiment of a system 150 for aligning a point of aim with a point of impact for a projectile device, wherein the embodiment includes or is fashioned to receive a remote activation switch 152 for the at least one superposition device. Such switches can be handy to reduce rifle movement when activating embodiments having a laser light or other switchable superposition device.

Figures 1, 14A:
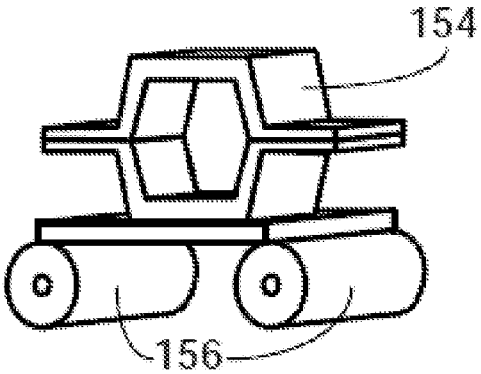
Figures 2, 14A:
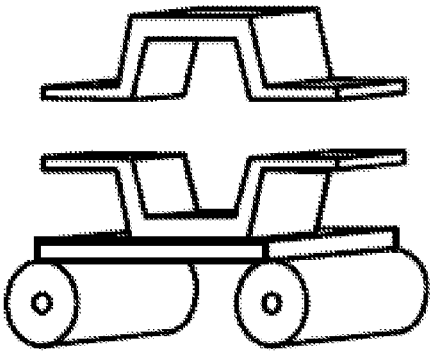
Figures 1, 14B:
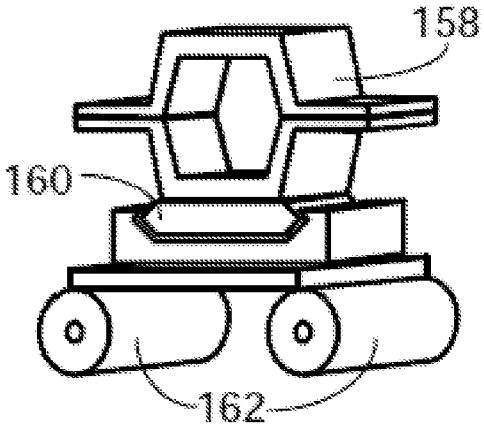
Figures 2, 14B:
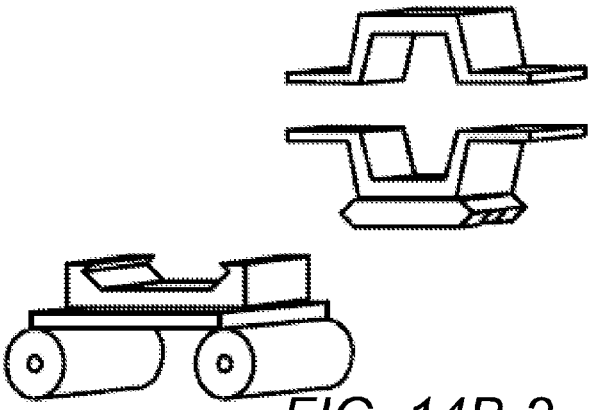
Figures 1, 14C:
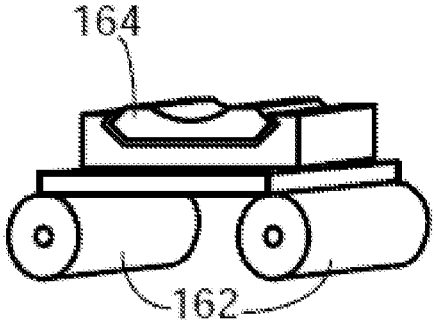
Figures 2, 14C:
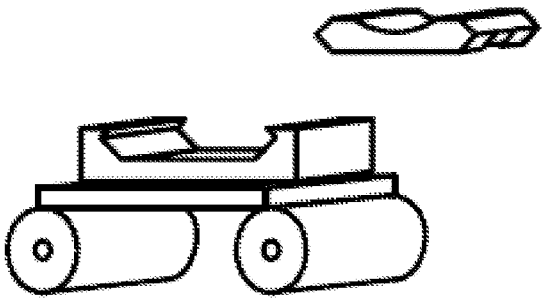

FIGS. 14A-1, 14B-1, and 14C-1 schematically illustrate non-exhaustive embodiments of different mounting methods for coupling at least one projection device to a projectile device. For simplicity, screws are not illustrated. FIG. 14A-1 illustrates an angular clamping device 154 which can be tightened onto a rifle barrel. The projection device 156 is permanently coupled to the clamp 154. The device of FIG. 14B-1 is similar to the one from FIG. 14A-1, however, the clamp 158 is fitted with a mounting rail 160 so that the projection devices 162 can be removed from the clamp 158 without removing the clamp 158 from the barrel. Numerous mounting rails, similar to the one illustrated are known to those skilled in the art. In clamp embodiments, a padded lining may be included for placement between the clamp and the gun barrel to reduce the amount of recoil transferred to the projection device. In other embodiments, such as the embodiment of FIG. 14C-1, a guide rail 164 may be provided for direct attachment to detents threaded posts or tapped holes in the barrel, enabling the superposition device 162 to be quickly removed or attached to the guide rail 164. Numerous other attachment methods are known to those skilled in the art and are intended to be covered in the scope of this description and the attached claims. FIGS. 14A-2, 14B-2, and 14C-2 schematically illustrate partially exploded views of the embodiments of FIGS. 14A-1, 14B-1, and 14C-1, respectively.

Figure 15:
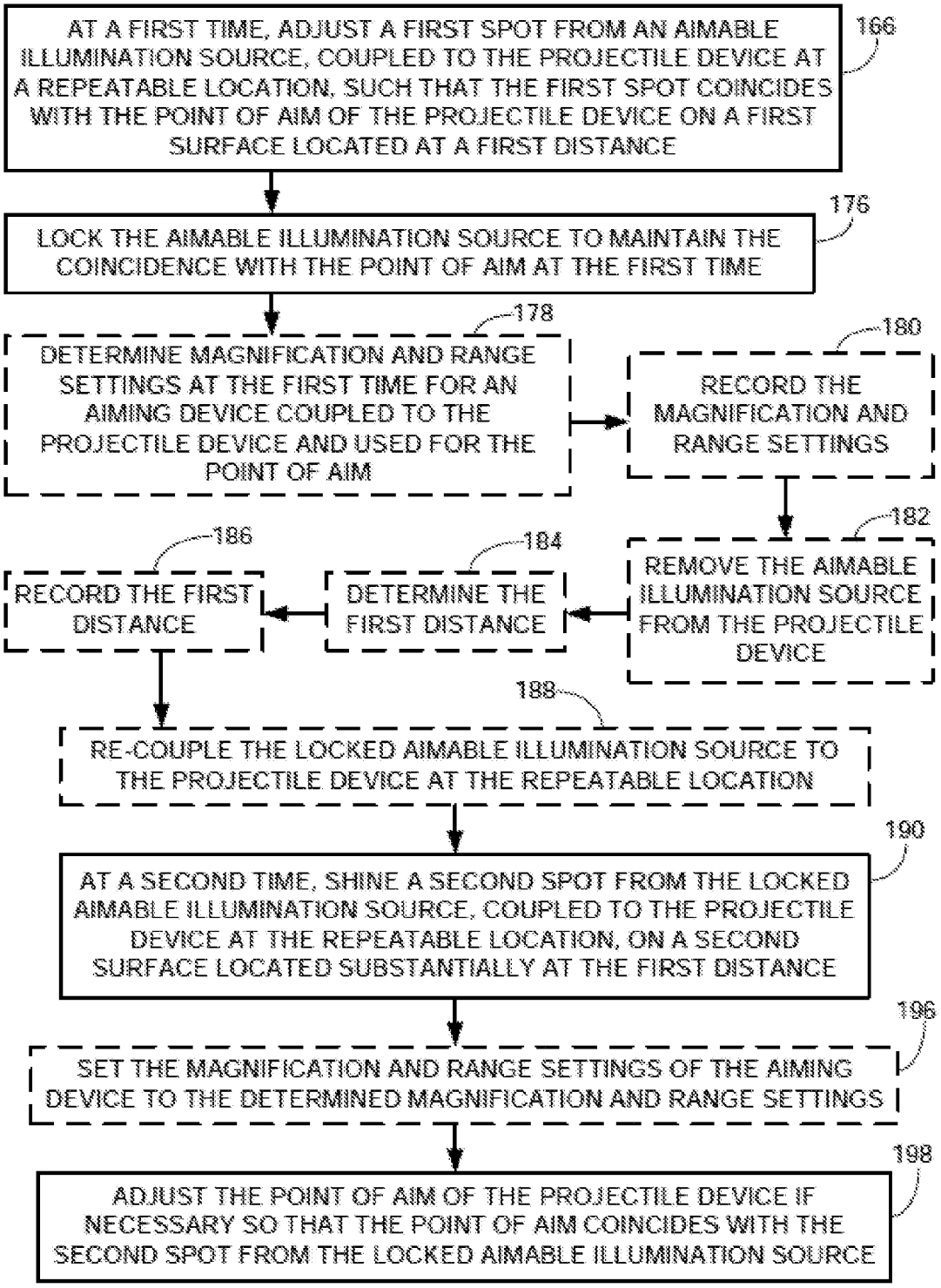
FIG. 15 illustrates one embodiment of a method of indicating a relationship between a point of aim and a point of impact for a projectile device.
Figure 16A:
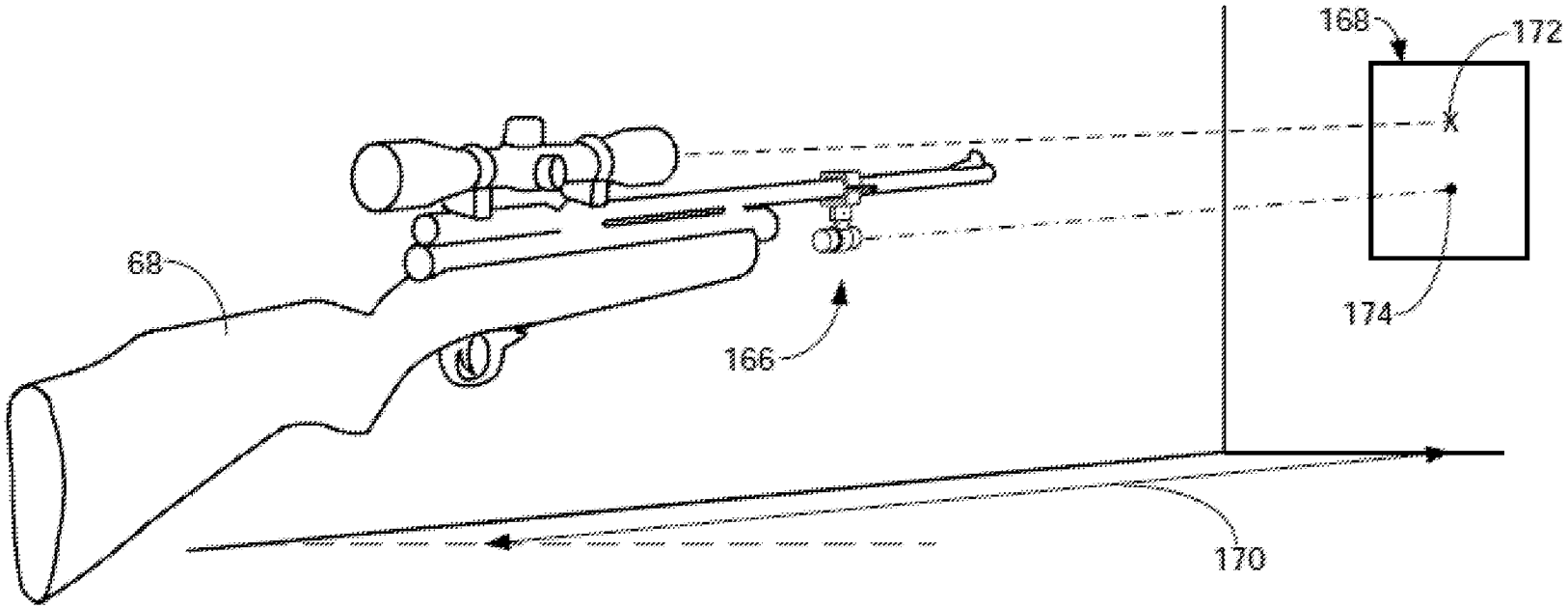
FIG. 16A schematically illustrates one embodiment of a system, coupled to a rifle, for indicating a relationship between a point of aim and a point of impact.
Figure 16B:
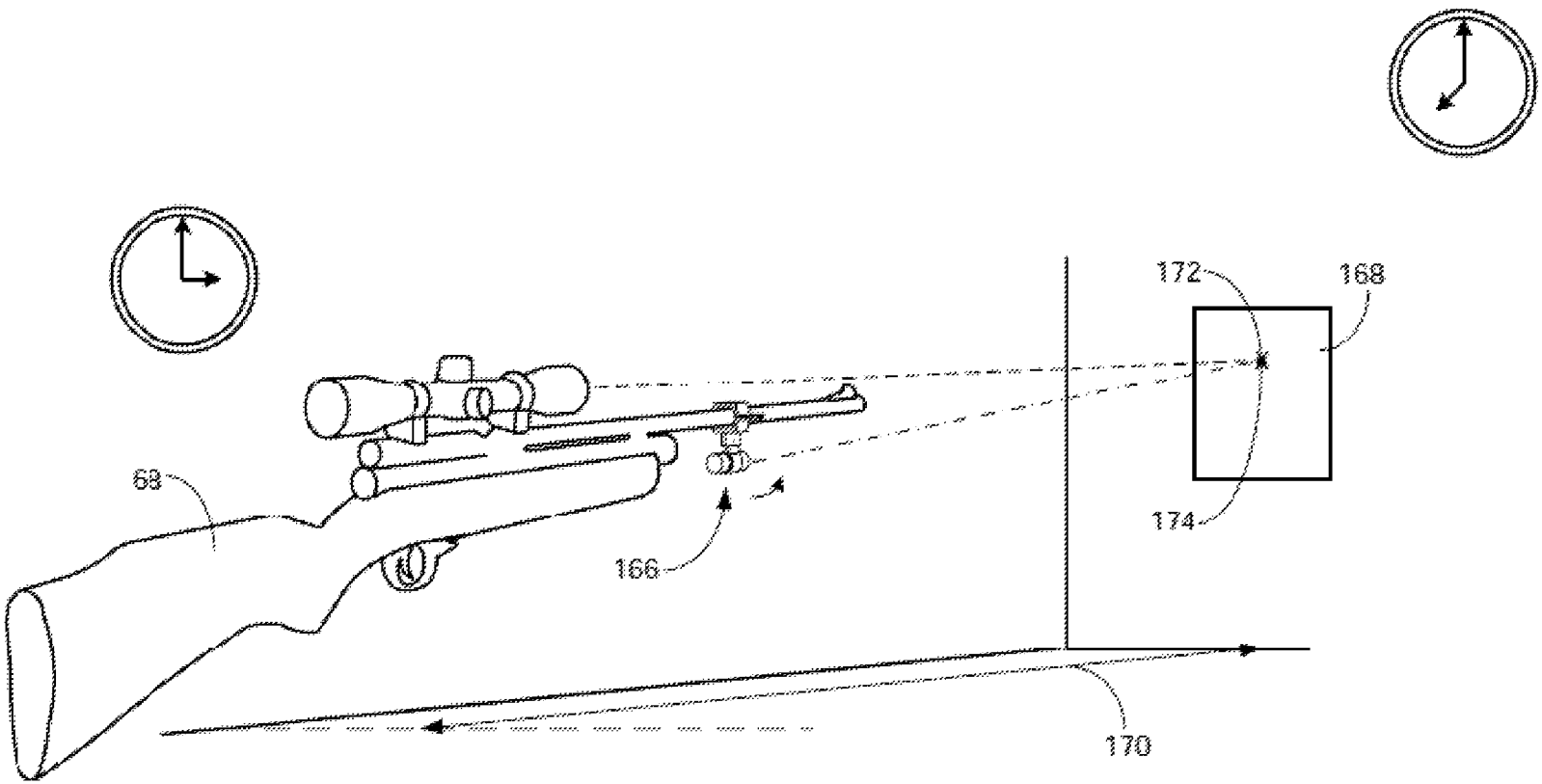
FIG. 16B schematically illustrates, at a first time, adjusting a first spot from an aimable illumination source, coupled to the projectile device at a fixed location, such that the first spot coincides with the point of aim of the projectile device on a first surface located at a first distance.
Figure 16C:
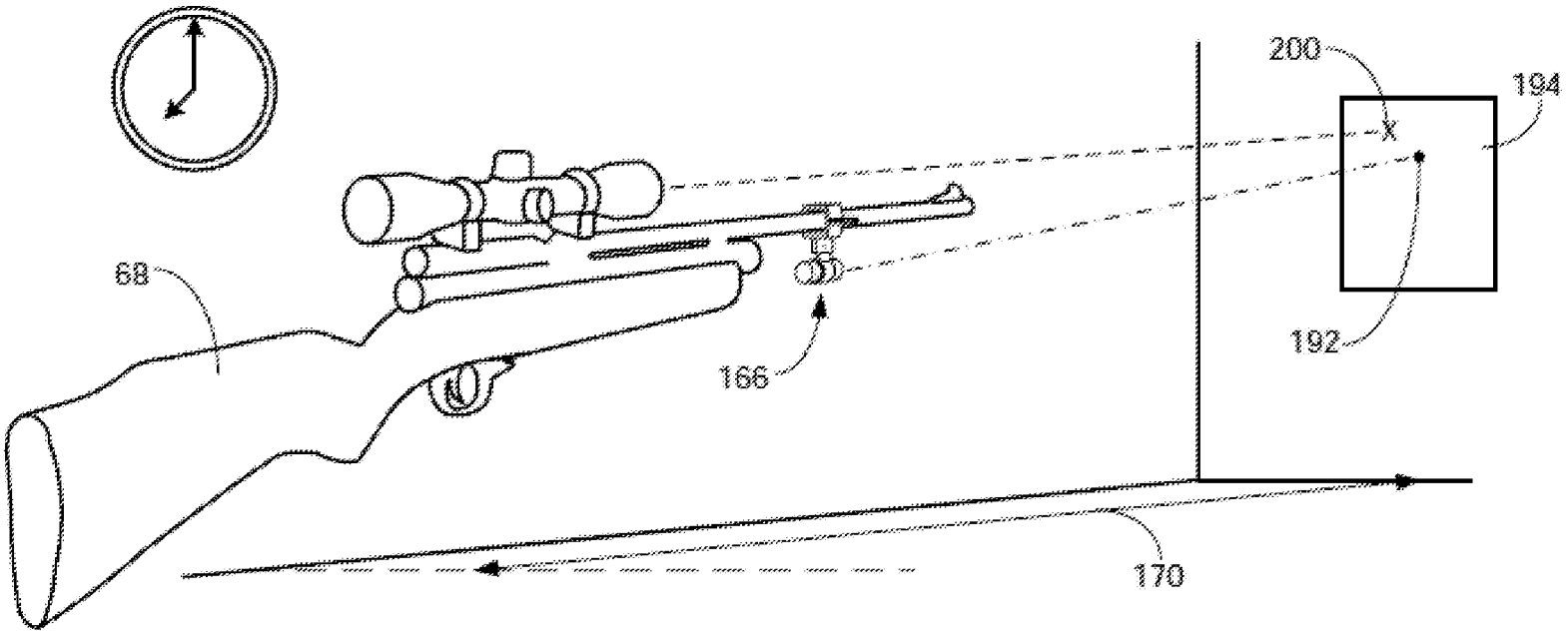
FIG. 16C schematically illustrates, at a second time, shining a second spot from the locked aimable illumination source, coupled to the projectile device at the fixed location, on a second surface located substantially at the first distance.
Figure 16D:
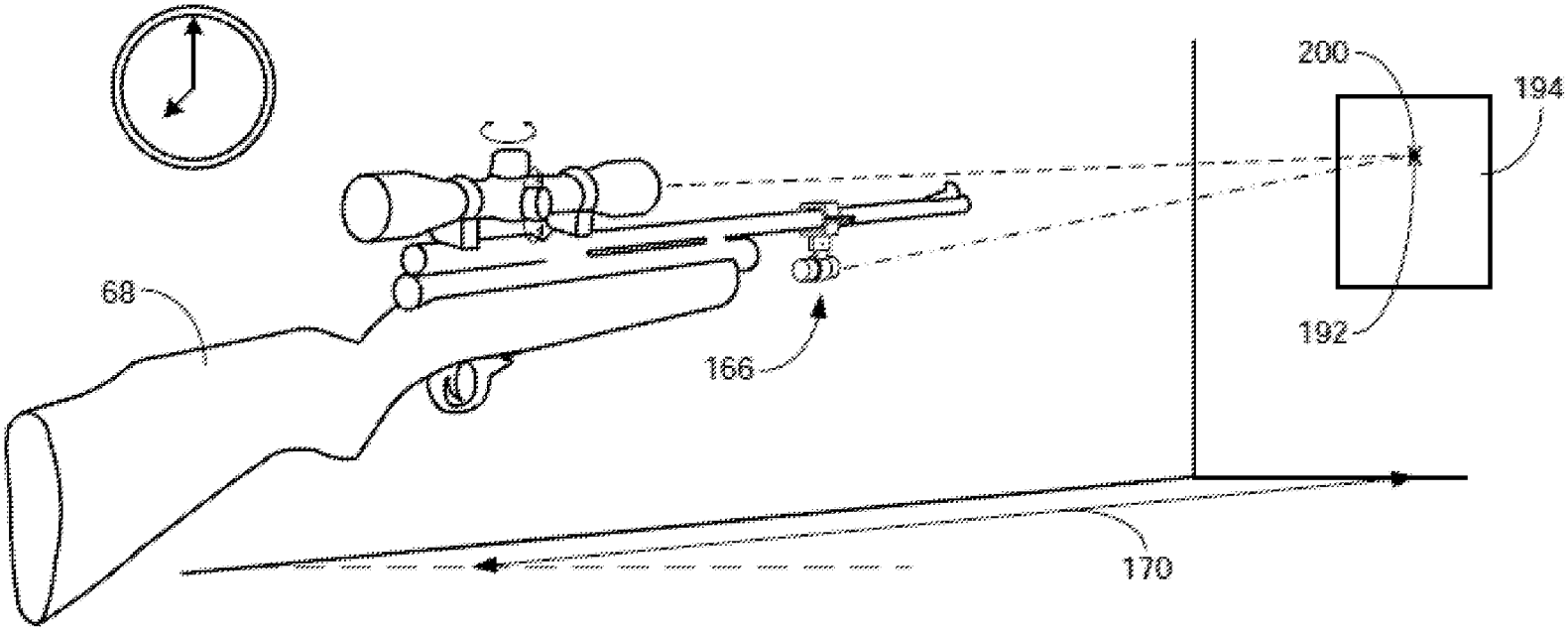
FIG. 16D schematically illustrates adjusting the point of aim of the projectile device so that the point of aim coincides with the second spot from the locked aimable illumination source.

The methods disclosed herein are highly effective for efficiently and accurately zeroing a projectile device. Once a device is known to be zeroed, it is also useful to have a method and system for ensuring the projectile device is kept in a zeroed condition and if not, providing a way to quickly rezero the projectile device. Accordingly, FIG. 15 illustrates one embodiment of a method of indicating a relationship between a point of aim and a point of impact for a projectile device. The method of FIG. 15 is described with additional reference to FIGS. 16A-16D which schematically illustrate the system and its various steps. FIG. 16A schematically illustrates a system for indicating a relationship between a point of aim and a point of impact. The system comprises an aimable illumination source 166 configured to be coupled to the rifle (projectile device) 68 at a repeatable location. The rifle 68 can be aimed at a target or surface 168 a first distance 170 from the projectile device 68. This establishes a point of aim 172. The aimable illumination source 166 pivots in a plane which intersects the point of aim 172 and creates a first spot 174. In step 166, from FIG. 15, and with regard to FIG. 16B, at a first time, the first spot 174 from the aimable illumination source 166, coupled to the projectile device 68 at a repeatable location, is adjusted such that the first spot 174 coincides with the point of aim 172 of the projectile device on a first surface 168 located at a first distance 170. In step 176, from FIG. 15 the aimable illumination source 166 is locked to maintain the coincidence with the point of aim 172 at the first time. In optional step 178, the magnification and range settings at the first time may be determined for the aiming device coupled to the projectile device and used for the point of aim. In optional step 180, the determined magnification and range settings may be recorded. In optional step 182, the aimable illumination source may be removed from the projectile device so that it may be protected. A variety of storage options exist for the aimable illumination source, including a hollowed out portion of a rifle stock. In optional steps 184, 186, the first distance 170 may be determined and recorded. If the aimable illumination source was removed from the projectile device in optional step 182, then at a later time, prior to checking the zero status of the projectile device, in optional step 188 the locked aimable illumination source may be recoupled to the projectile device at the repeatable location. In step 190 from FIG. 15, and with regard to FIG. 16C, at a second time, a second spot 192 from the locked aimable illumination source 166, coupled to the projectile device 68 at the fixed location, is shined on a second surface 194 located substantially at the first distance 170. In optional step 196, the magnification and range settings of aiming device are set to the determined magnification and range settings. In step 198 from FIG. 15, and with regard to FIGS. 16C and 16D, the point of aim 200 of the projectile device 68 is adjusted, if necessary, so that the point of aim 200 coincides with the second spot 192 from the locked aimable illumination source 166.

Figures 1, 17A:
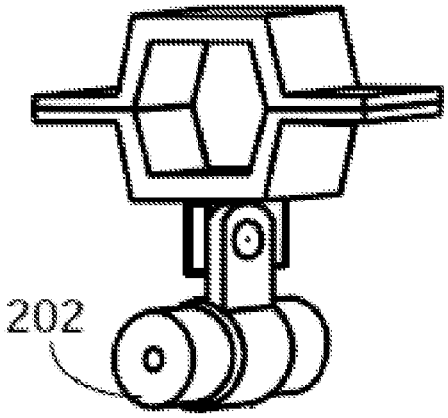
Figures 2, 17A:
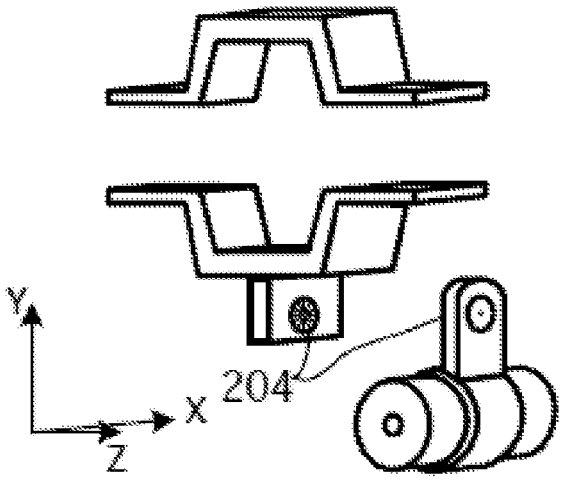
Figures 1, 17B:
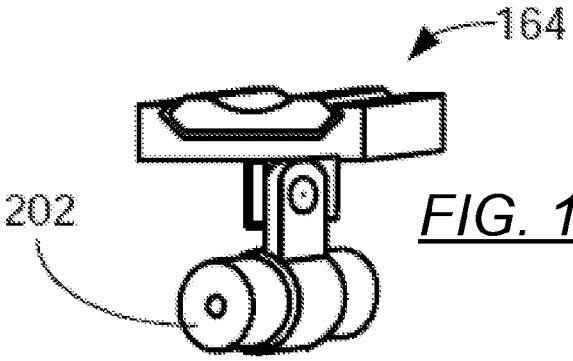
Figures 2, 17B:
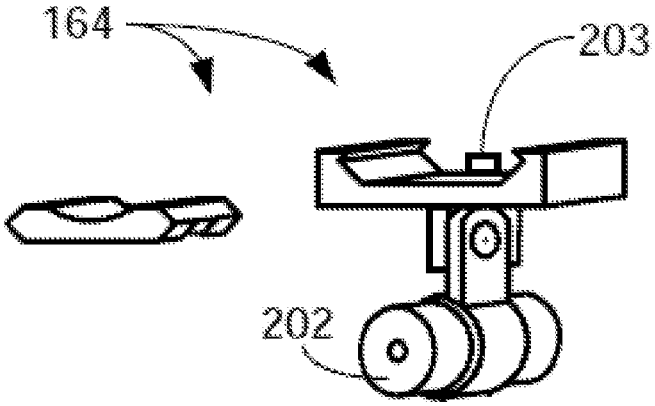

FIG. 17A-1 schematically illustrates an embodiment an aimable illumination source 202 that may be coupled to a projectile device. Various clamps guides, and mounting options, similar to those discussed above, are known to those skilled in the art and may be used to couple to the projectile device. FIG. 17A-2 schematically illustrates a partially exploded view of the aimable illumination source of FIG. 17A-1. Since the aimable illumination source would need to be locked in place, this non-limiting embodiment utilizes a pair of star nuts 204 on a pivot joint that can be loosened to adjust a pivot angle and tightened to preserve the angle. FIG. 17B-1 illustrates another embodiment of an aimable illumination source 202 that may be coupled to a projectile device, in this case, with a guide rail 164 which may be provided for direct attachment to detents, threaded posts, or tapped holes in the barrel, enabling the aimable illumination source 202 to be quickly removed or attached to the guide rail 164. FIG. 17B-2 schematically illustrates a partially exploded view of the aimable illumination source of FIG. 17B-1. In some embodiments, a stop 203 may be provided to facilitate coupling of the aimable illumination source 202 to the projectile device at a repeatable location.

Figure 18:
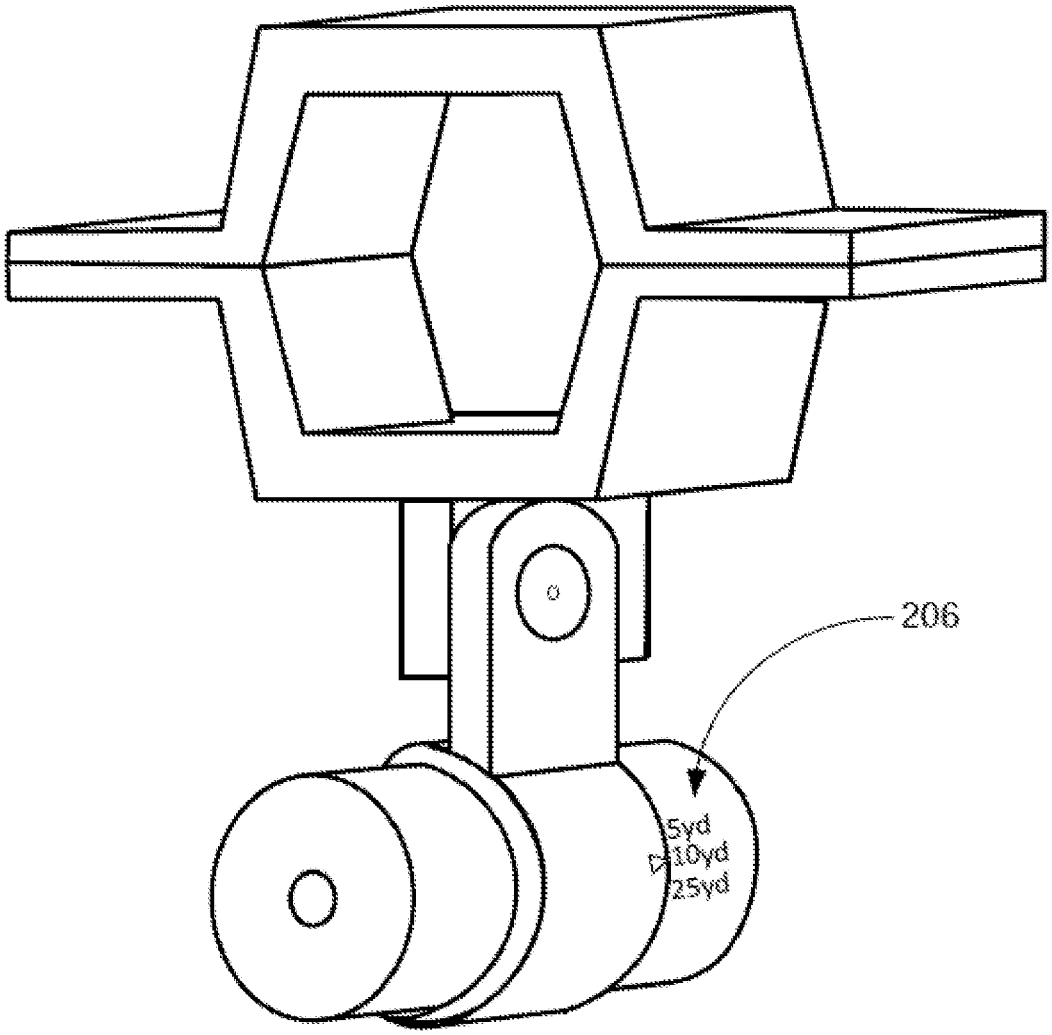
FIG. 18 schematically illustrates one embodiment of a system for indicating a relationship between a point of aim and a point of impact for a projectile device, wherein the system has an embodiment of an index for recording a distance.

FIG. 18 schematically illustrates one embodiment of a system for indicating a relationship between a point of aim and a point of impact for a projectile device, wherein the system has an embodiment of an index 206 for recording a distance. In this embodiment, the index is integrated with the illumination device and its mounting hardware. The illumination device, or a shell on its outer edge can be rotated to align a marked distance with an arrow. This distance can be the first distance discussed above with respect to FIG. 15. Similar recording devices (tabs, rings, etc.) may be built into the system to make it easier to record the distance, magnification, and range settings.

Figure 19:
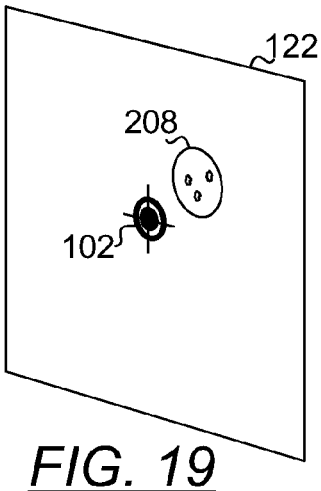
FIGS. 19-21 depict the results of a series of conventional steps taken to zero a projectile device.
Figure 20:
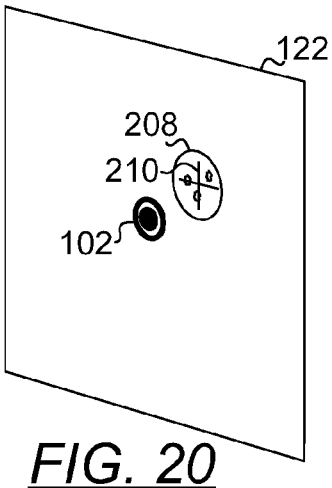
Figure 21:
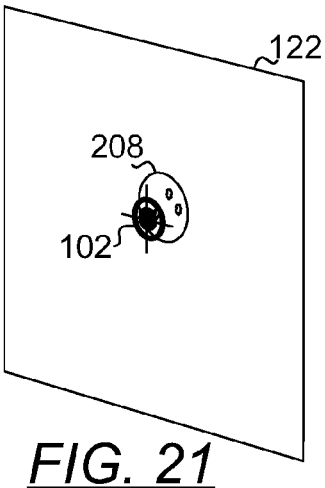

FIGS. 19-21 depict the results of a series of conventional steps taken to zero a projectile device. A shooter aims crosshairs to bisect a target and fires a three-round group of bullets to produce three points of impact 208. FIG. 19 depicts bullets having struck above and to the right of target ring 102. The shooter then estimates the centroid 210, i.e., the central spot of bullet holes or points of impact 208. The shooter then aims crosshairs 42, 44 (see FIG. 2) to bisect the target at centroid 210. The shooter then fires another three-round group of bullets to produce another three points of impact 208. The shooter continues this shoot/adjust scope procedure until he or she is satisfied that the centroid 210 and crosshairs 42, 44 (see FIG. 2) are both on the bullseye inside the target ring 102. There are several disadvantages associated with this conventional method. This system requires estimating the centroid and firing many rounds to achieve the desired results, thereby wasting many rounds in the zeroing process, i.e., even before a projectile is being put to use. As the shooter continues to achieve zero, the shooter may begin to anticipate recoil-shock and experience the involuntary reflex known as flinching, further prolonging the process of zeroing. Firing successive rounds generates heat distortion of both the sight picture and barrel accuracy, causing the zeroing process to be ineffective as the effects of heat distortion are not considered.

Other methods of attaining zero require the use of (1) boresighters or (2) collimators. Bore sighters are inserted into a barrel or chamber or magnetically attached to a gun barrel. They indicate the line of the gun's bore to target, not the bullet path. The collimators also indicate the path of the bore but enables user to establish a starting point for zeroing. As such, these two methods are fundamentally flawed as the bore to target and bullet path are not coincident as indicated elsewhere herein.

Figure 22:
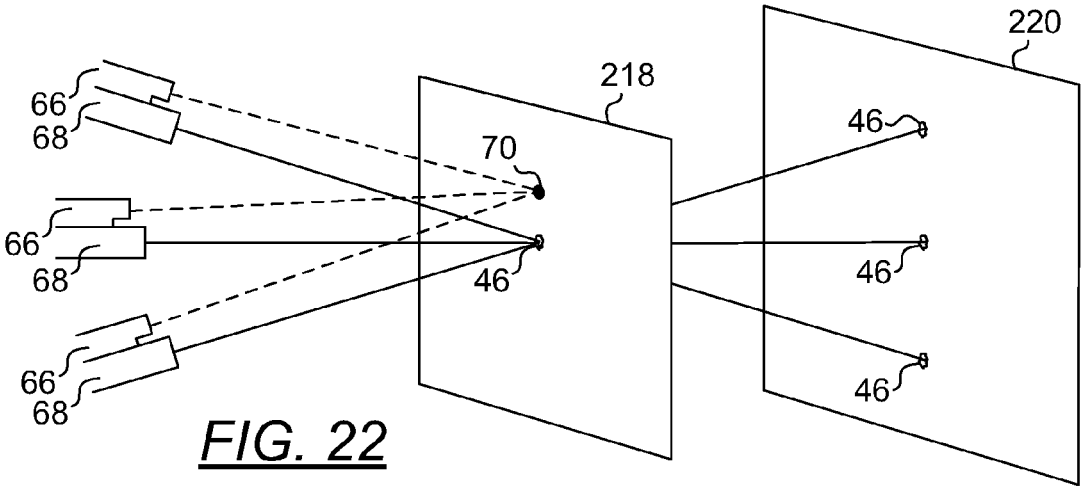
FIG. 22 depicts an effect of using only one reference point in zeroing a projectile device.

FIG. 22 depicts an effect of using only one reference point in zeroing a projectile device. Although a single marking beam (or simply beam) is shown to be utilized in limited circumstances as disclosed elsewhere herein to zero a projectile device, it cannot indicate the distance from a superposition device to a target as a single reference point can be maintained (or superposed) even though a projectile device 68 to which the superposition device 66 is moved and hence alters the path of a bullet. The alignment of a single reference beam, when projected onto a target, can be maintained or resumed in spite of the changes in posture (pitch angle, yaw angle and roll angle) and the distance of the superposition device 66 from the target. The superposition device 66 can be tilted at various pitch angles or moved laterally left or right on a horizontal plane and the beam can still be located at the same spot on the target as shown in the proximal plane 218 of FIGS. 22 and 23. The superposition device 66 can also be moved towards or away from the target without indicating any change of distance. If any of these movements are executed, the points of impact 46 on the proximal plane 218 may remain accurate but the far target as indicated on the distal plane 220 will be far from being accurate as indicated by non-coincidental points of impact 46 on the distal plane 220. As shown in FIG. 22, the reference point 70 can be superposed even if the pitch angle of the projectile device is adjusted up and down. It shall be noted that the paths of bullet, as indicated by the lines penetrating the points of impact 46, trace substantially different paths aligned vertically (as indicated by the point of impacts 46 on the distal plane 220) as the pitch angle of the projectile device 68 is altered and even when the superposition device 66 still superposes the reference point 70.

Figure 23:
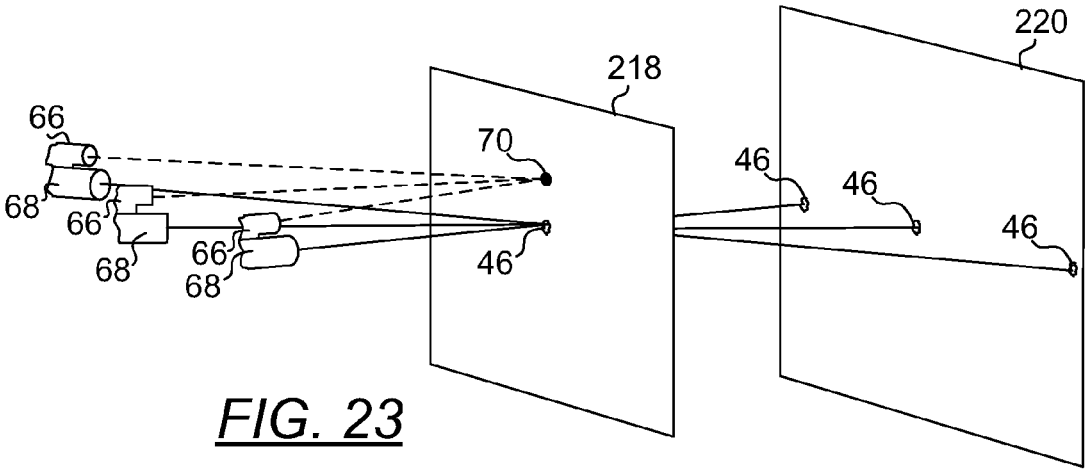
FIG. 23 depicts yet another effect of using only one reference point in zeroing a projectile device.

FIG. 23 depicts yet another effect of using only one reference point in zeroing a projectile device. In this case, the reference point 70 can be superposed even if the yaw angle of the projectile device is altered. It shall be noted that the paths of bullet, as indicated by the lines penetrating the points of impact 46, trace substantially different paths aligned horizontally (as indicated by the point of impacts 46 on the distal plane 220) as the yaw angle of the projectile device 68 is altered and even when the superposition device 66 still superposes the reference point 70. When only one reference point is used in zeroing, a stable base on which the projectile device can be repeatably held and positioned, is critical. Referring back to FIG. 1, a lead sled 244 may be used as a stable base. Other examples of a stable base includes, but not limited to, a bench, a bean bag rest and a naturally available material, e.g., a log, a forked branch and a tripod. In applications where accuracy is not critical, the use of a single reference point is acceptable. In addition, in close-range applications, a weapon zeroed using only a single reference point may suffice.

FIG. 24 depicts an effect of using two reference points in zeroing a projectile device. Although the use of two reference points may be satisfactory in limited circumstances, inexperienced shooters may find it difficult to zero a projectile device using a single round. Similar to the effect depicted in FIG. 22 for one reference point, the reference points 70 can be superposed even if the pitch angle of the projectile device is varied as depicted in FIG. 24. One difference between the use of a single reference point and two reference points lies in the divergent configuration of beams of the superposition device 66 in FIG. 24. Therefore there is one unique distance from the superposition device 66 to the reference points 70. The beams from the superposition device 66 will fail to superpose the reference points 70 if the superposition device 66 is moved away from this unique distance between the superposition device 66 and the reference points 70. It shall be noted that even with divergent beams of a two reference point system, in order to achieve a unique position and posture, the user of such system will still need to ensure that the pitch angle of the superposition device 66 is unique, as evidenced by the different points of impact 46 on the distal plane 220 if the pitch angle of the superposition device 66 is not maintained. The use of two reference points requires that the yaw angle of the superposition device 66 be maintained such that the reference points 70 may be superposed, leaving open a potential change in the pitch angle of the superposition device 66. As the beams are divergent, any change in distance from the superposition device to the target will be readily indicated. The Applicant discovered that by using three diverging beams in a superposition device, coupled with superposing of the three beams on three reference points at a first target area, unique spatial location, pitch angle, yaw angle and roll angle of the superposition device 66 can be achieved. Reference points comprised of other shapes, such as those disclosed in FIGS. 7C-7E may also be used provided that at least three reference points may be indicated in each of such shapes.

FIG. 25 depicts an effect of using three parallel beams 216 and their corresponding reference points in zeroing a projectile device 68. With parallel beams, the spatial location of the superposition device 66, at which it is capable of superposing the reference points 70 is not unique. For instance, when disposed at positions A and B at unique pitch and yaw angles, a superposition device 66 is capable of superposing the reference points 70. As the bullet trajectory traces a curved path as shown in FIG. 1, such arrangement is unsatisfactory especially in portions of the bullet trajectory 36 where a bullet deviates from the line of sight 34 (see FIG. 1).

FIG. 26 depicts an effect of using three diverging beams and their corresponding reference points in zeroing a projectile device 68. By using three reference points on a target, any change of posture of a projectile device is indicated and if at least one beam is divergent relative to at least one of the two other beams, there exists a unique posture of the projectile device 68 (to which a superposition device is attached) which will produce a beam pattern that corresponds exactly to the three reference points 70 with unique distances between the reference points 70. As shown in FIG. 26, the area encompassed by the triangular pattern of the three reference points 70 at the proximal plane 218 is larger than the area encompassed by beams emanating from the superposition device 66. The area encompassed by the triangular pattern of the three reference points 70 at the distal plane 220 is even larger as the distal plane 220 is disposed farther than the proximal plane 218 from the superposition device 66. In the embodiment of FIG. 26, no two beams are parallel. FIG. 26A depicts an effect of using two parallel beams and a third beam orientated at an angle to the two parallel beams and the corresponding reference points of all three beams in zeroing a projectile device. Similar to effect of the diverging beams of FIG. 26, the arrangement with the lone upper beam disposed at an angle with any one of the two lower beams requires that the superposition device 66 be positioned at a unique posture to produce exact patterns at the proximal and distal planes 218, 220. The beam embodiment shown in FIG. 26A is also referred to as diverging beams as the footprint of the beams at a distal plane is larger than the footprint of the beams at a proximal plane. It is to be understood that the total number of diverging beams may be increased to four or more to achieve even more accurate result. However, the increase to four beams greatly increases the level of difficulty in superposing all of the beams on the reference points and yields little to no discernible benefits compared to the use of three beams. In one embodiment, the reference points and target ring may be pre-printed on a target. In another embodiment, the target may be pre-printed and the reference points may be marked according to the beams of the superposition device.

FIG. 26B depicts an effect of using three converging beams and their corresponding reference points in zeroing a projectile device 68. Although less desirable than three diverging beams as the transmitting area of the superposition device will need to be larger in order to accommodate three more widely spread projection devices and that the footprint of the beams made at distal planes will be less discernible (smaller), it is also conceivable that the beams be made converging as this arrangement also requires that a unique posture be used in superposing the reference points 70.

Figure 27:
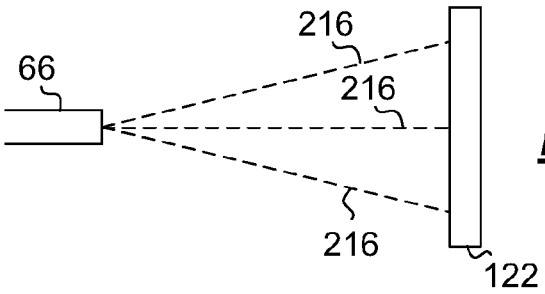
FIGS. 27-29 depict effects of adjusting the divergence of three beams on the footprint encompassed by the three reference points made by the three beams.
Figure 28:
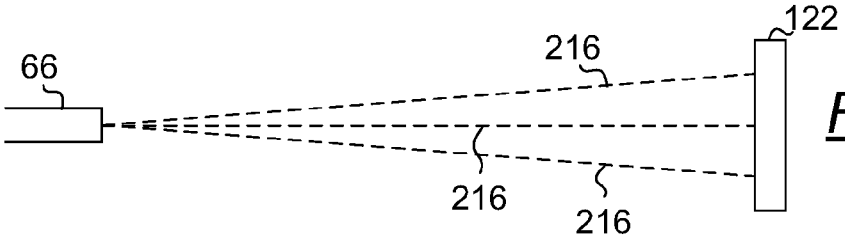
Figure 29:
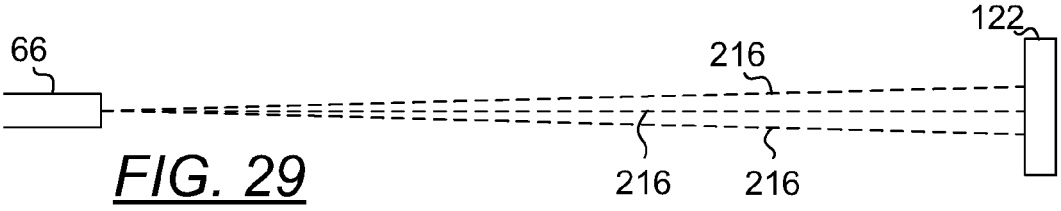
Figure 30:
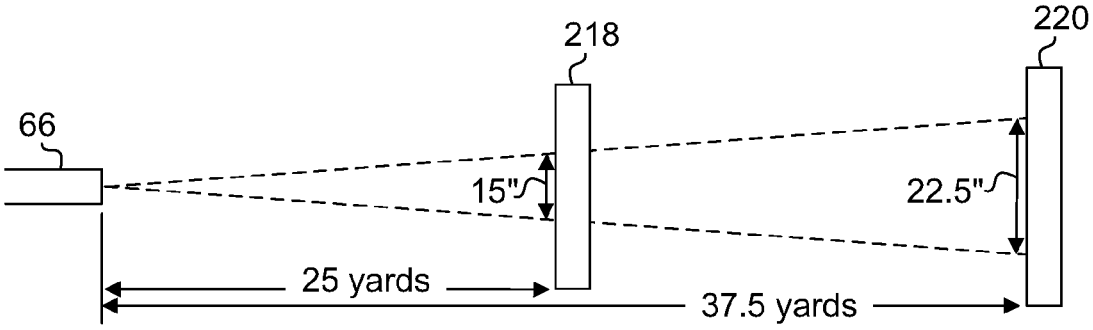
FIG. 30 depicts effects of the divergence of beams at various target distances from a source.

FIGS. 27-29 depict effects of adjusting the divergence of three beams on the footprint encompassed by the three reference points made by the three beams. It shall be noted that a small angle adjustment at the source (superposition device 66) can cause a large change in the area of the footprint at a distal plane. An example of such magnification is depicted in FIG. 30 where, due to a divergence of 1 degree, a footprint (or distance between two beams) of about 15 inches results at a 25-yard target. At 37.5 yards from the superposition device 66, this becomes a footprint measuring about 22.5 inches.

Figure 31:
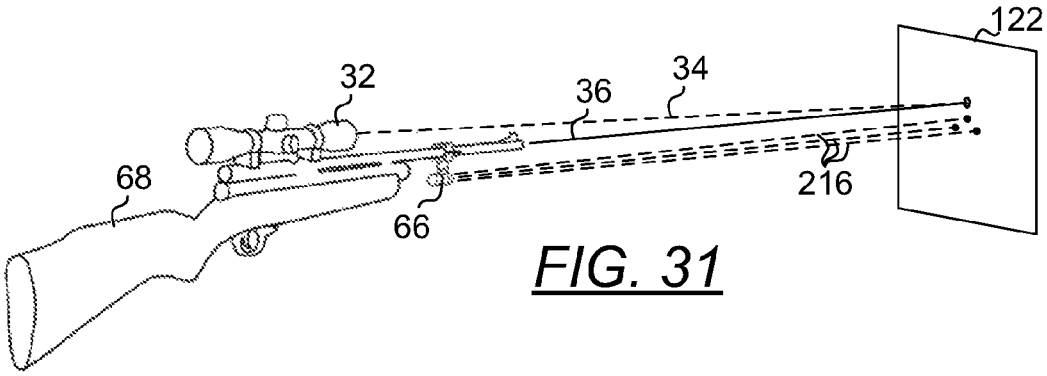
FIG. 31 depicts an alignment of a projectile device with a target using a superposition device having three diverging beams and the corresponding reference points of the three beams in zeroing a projectile device.
Figure 32:
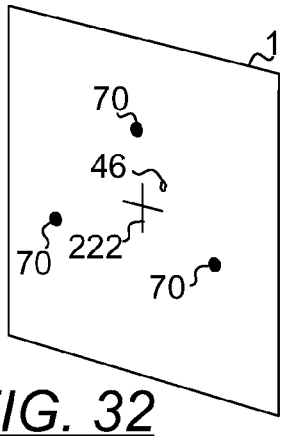
FIGS. 32-34 depict the results of a present series of steps taken to zero a projectile device using three reference points.
Figure 33:
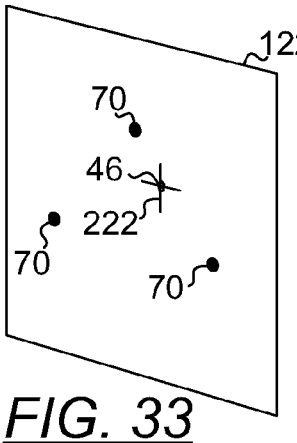
Figure 34:
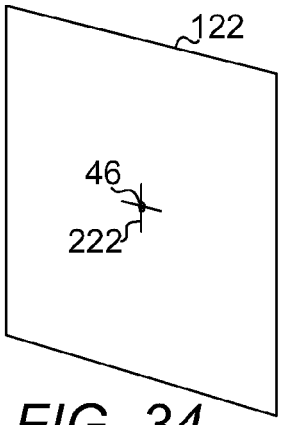

FIG. 31 depicts an alignment of a projectile device with a target using a superposition device having three diverging beams and the corresponding reference points of the three beams in zeroing a projectile device. FIGS. 32-34 depict the results of a present series of steps taken to zero a projectile device using three reference points. In FIG. 32, a shooter projects or superposes three beams onto reference points 70 and fires one round to cause a point of impact 46, without regard for a bullseye. The projection 222 of crosshairs represents the mark as seen through the scope 32 but not actually present at a target. The shooter then marks dots or reference points 70. The shooter may alternately use a printed target with dot positions already indicated by circles 70. While maintaining or resuming relationship of the three beams 216 to reference points 70, the shooter adjusts crosshairs 42, 44 of the scope 32 to bisect bullet hole or point of impact 46. The scope 32 is now "zeroed" and the crosshairs 42, 44 (or its projection 222) indicates a point of impact 46 the next time a shot is taken from the projectile device 68 to which the scope 32 is attached.

Figure 35:
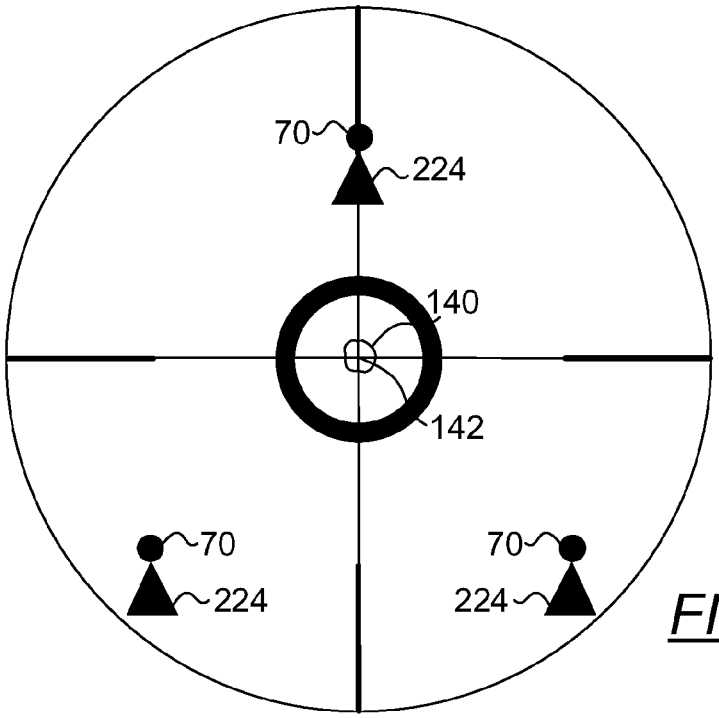
FIG. 35 depicts one embodiment of a view through the projectile device scope of FIG. 31, wherein three alignment points of the projectile device scope are projected through superimposition of the scope's three alignment points onto the three reference points within the first target area.

FIG. 35 depicts one embodiment of a view through the projectile device scope of FIG. 31, wherein three alignment points of the projectile device scope are projected through superimposition of the scope's three alignment points 224 onto the three reference points 70 within the first target area. Instead of using a separately available superposition device, such alignment points 224 may be incorporated into the scope 32. In one embodiment, the positioning of the alignment points 224 may be adjustable, much like the means by which the optical reference points of a scope may be adjusted for specific distances to a target as shown in FIG. 10C. Other means of adjustment of the alignment points disclosed elsewhere herein for systems using one or two reference points may also be readily adopted for the embodiment using three reference points.

Figure 36:
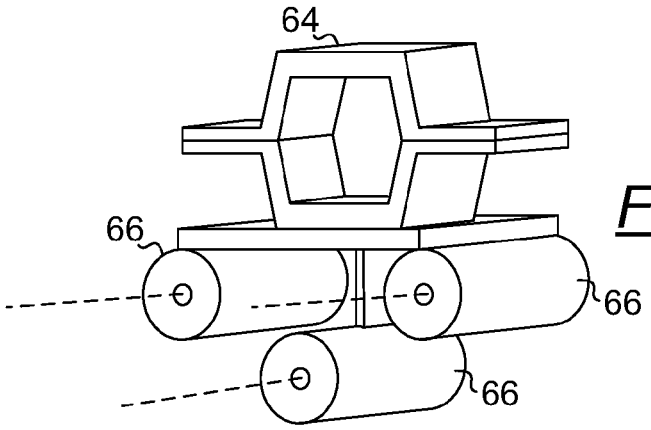
FIG. 36 depicts an embodiment of a mounting method for coupling at least one projection device having three separate beams to a projectile device.
Figure 37:
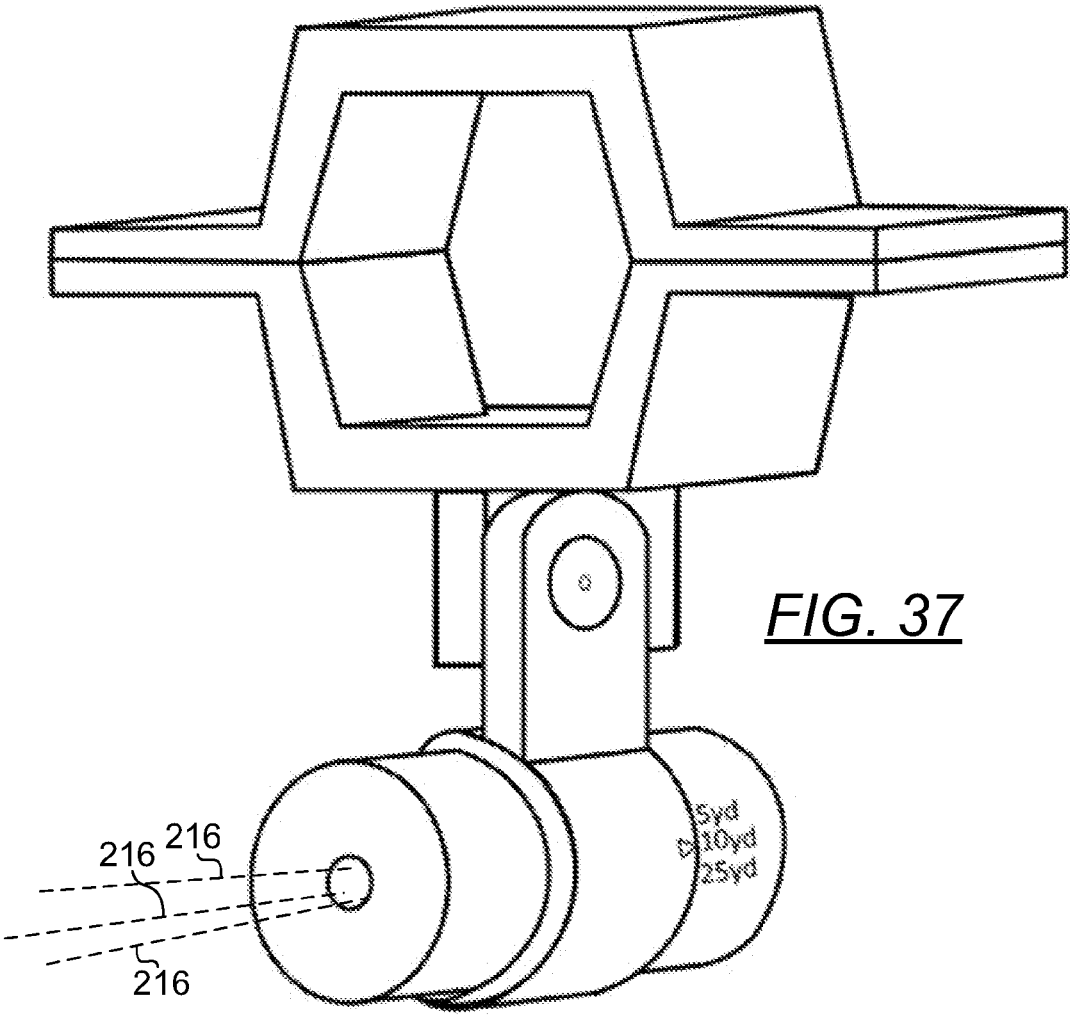
FIG. 37 depicts one embodiment of a system for indicating a relationship between a point of aim and a point of impact for a projectile device, wherein the system has a means for adjusting the divergence of the beams to create suitably sized beam footprint to superpose reference points disposed at various distances from the projectile device.
Figure 38:
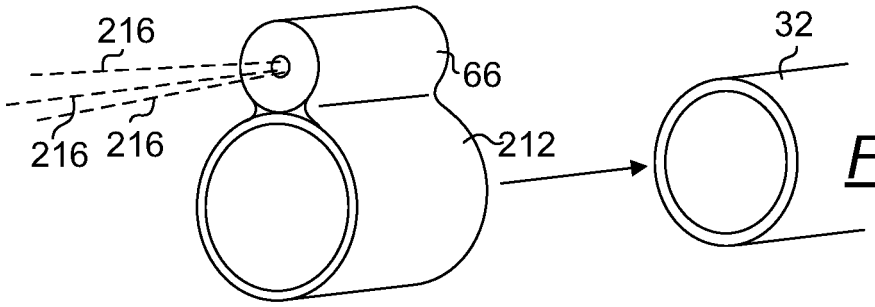
FIG. 38 depicts a rubberized sleeve to which a superposition device having three beams is attached, the sleeve is configured to be slid on a scope to secure the superposition device to a projectile device.
Figure 39:
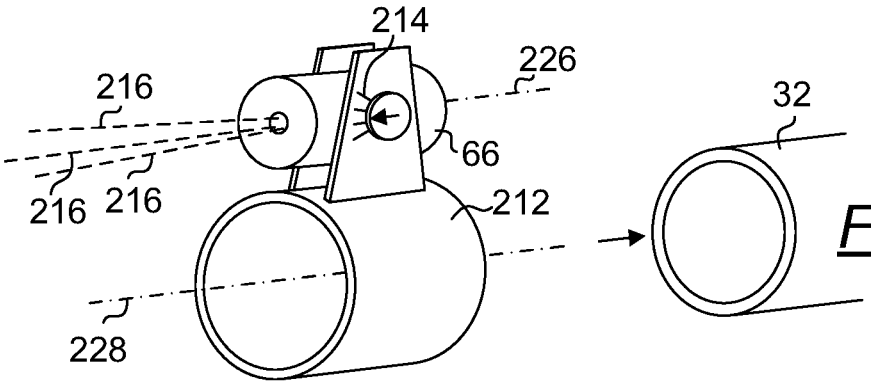
FIG. 39 depicts a rubberized sleeve to which an adjustable superposition device having three beams is attached, the sleeve is configured to be slid on a scope to secure the superposition device to a projectile device.

FIG. 36 depicts an embodiment of a mounting method for coupling at least one projection device having three separate beams to a projectile device. FIG. 37 depicts one embodiment of a system for indicating a relationship between a point of aim and a point of impact for a projectile device, wherein the system has a means for adjusting the divergence of the beams 216 to create suitably sized beam footprint to superpose reference points disposed at various distances from the projectile device. In FIG. 37, all three beams are configured to be emitted using one single laser head. The beam splitting technique shown in FIG. 6B may be readily adopted to produce such configuration. FIG. 38 depicts a rubberized sleeve 212 to which a superposition device having three beams is attached. FIG. 39 depicts a rubberized sleeve 212 to which an adjustable superposition device having three beams is attached. The sleeve 212 is configured to be removably slid on a scope to secure the superposition device to a projectile device. In order to increase the adaptability of the present superposition device 66, in the embodiment shown in FIG. 39, a pitch angle adjuster 214 is further provided to enable the angle adjustment between the longitudinal axis of the sleeve 228 and the longitudinal axis of the superposition device 226. Other means of securing a superposition device to a projectile device disclosed elsewhere herein for systems using one or two reference points may also be readily adopted for the embodiment using three reference points.

Figure 40:
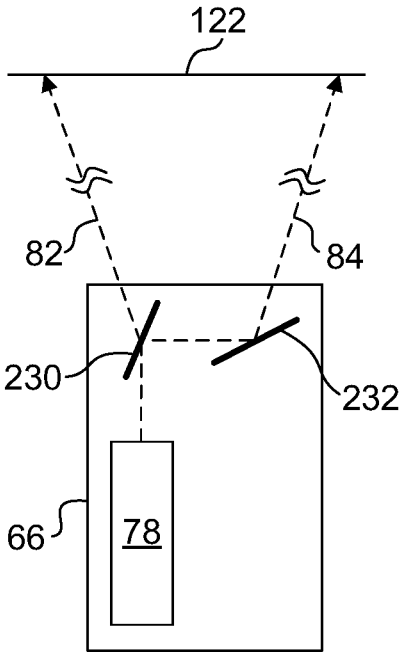
FIG. 40 depicts a focusable superposition device casting a pair of beams at a first degree of divergence.
Figure 41:
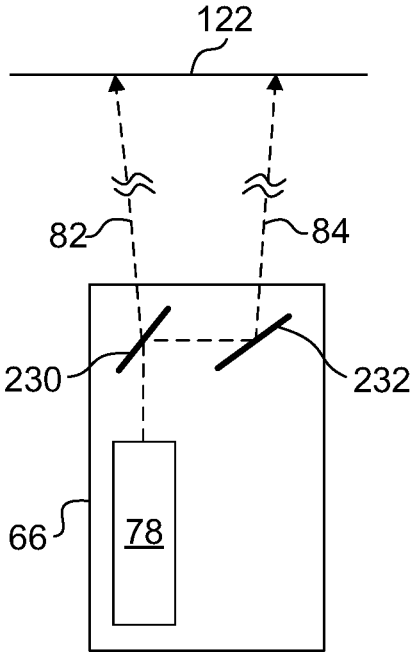
FIG. 41 depicts a focusable superposition device casting a pair of beams at a second degree of divergence.

FIGS. 40 and 41 depict a focusable superposition device casting a pair of beams at various degrees of divergence. For simplicity, only a pair of beams is used to demonstrate a mechanism that may be used to cause varying degrees of divergence. It shall be understood that the mechanism disclosed herein is intended to be presented by way of example only, and is not limiting. Such capability is necessary when it is impossible to superpose three beams on pre-printed reference points: (1) due to the unwillingness or inability of a shooter to adjust his or her distance or position to a target, or (2) if the triangular pattern of the pre-printed reference points is impossible to be superposed as the original pattern of the three beams of the superposition device does not match the triangular pattern of the pre-printed reference points. It shall be noted that by adjusting the angles of the beam splitter 230 and mirror 232, the divergence of the beams can be adjusted. The angles of the beam splitter 230 and mirror 232 may be individually adjusted or a linkage may be formed between the two parts such that an angle adjustment on one part causes an angle change on the other part.

FIG. 42 depicts a pre-printed target that is configured for used with pre-calibrating or zeroing a projectile device for a plurality of distances. The target includes three pre-printed references points 126 in a first target area and a plurality of target rings 38 disposed in a vertical fashion in a second target area. In use, the target is to be disposed at 25 yards from a projectile device that is to be zeroed. In order to zero the projectile device for striking targets at greater distances, e.g., 50, 100, 200 and 300 yards, the target only needs to be placed at 25 yards from the projectile device, thereby making it convenient for the user to zero his or her projectile device for great distances. A target ring 38 configured for a greater distance is disposed at a lower position on the target, in conformance with the trajectory of a projectile at such distance from a projectile device.

FIG. 43 depicts the use of a collimator 236 for sharpening a beam. Disposed in the path of the beam, the collimator 236 limits the size and angle of spread of the beam such that when used to superpose a reference point, the beam is not overly large and approximates the size of the reference point. By having a footprint 238 that is approximately the size of the reference point, the user can successfully superpose the reference point more readily as the user can gauge the concentricity of the footprint with respect to the reference point more easily. This is in stark contrast to an uncollimated footprint 240 which is overly large, especially at large distances from its source of illumination. For instance, an uncollimated laser beam can result in a footprint diameter of about 20 cm (due to changes in beam width) at about 100 yards from its source while a collimated laser will cause a footprint with a footprint diameter of about 2 cm at about 100 yards from its source.

Figure 44:
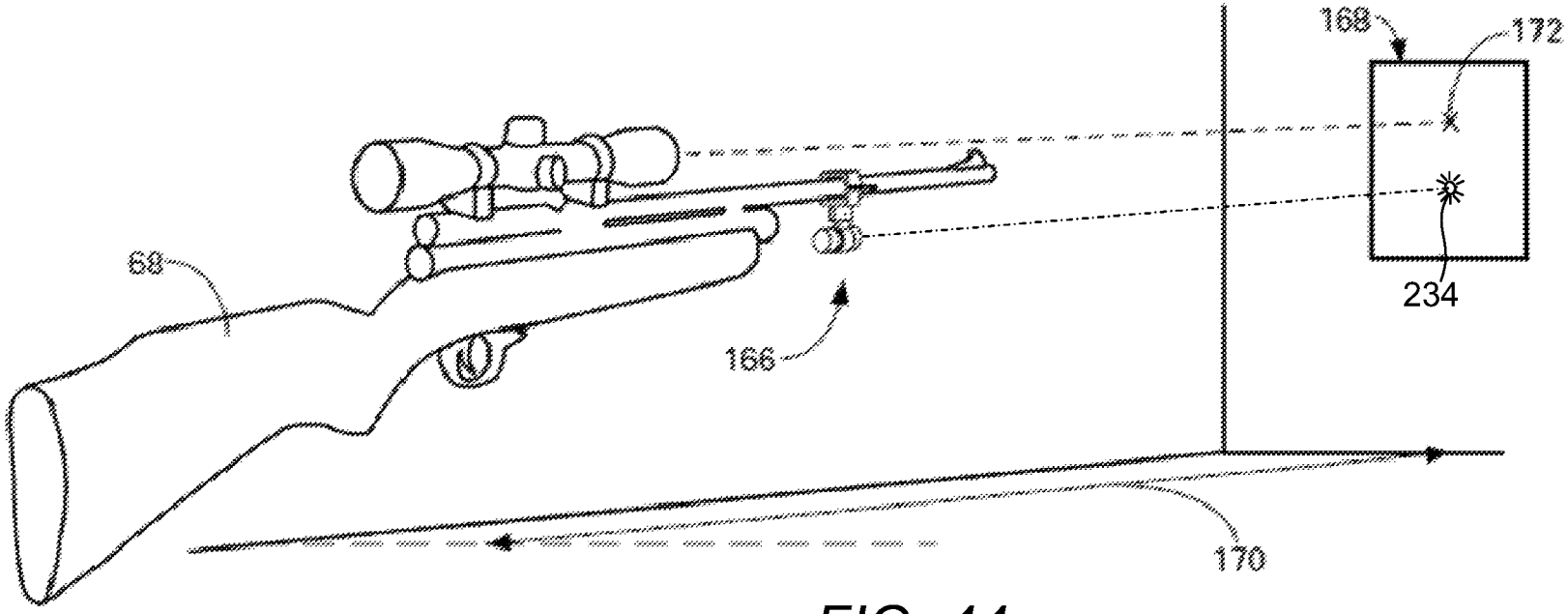
FIG. 44 depicts the use of a reflective reference point in zeroing a projectile device.

FIG. 44 depicts the use of a reflective reference point in zeroing a projectile device. The reflective reference point 234 is configured to draw the attention of a user when a weapon is being zeroed. When disposed outdoors and under natural sunlight, the reflective reference point 234 reflects the natural sunlight and draws the user's attention to the reference point quickly such that the weapon to be zeroed can be pointed in the right direction to superpose its optical reference on the right area quickly. Its use as an attention getter is enhanced further when a beam, e.g., laser, is shone upon the reflective reference point 234 when it is superposed as the beam is reflected, causing an unmistakable bright illumination to inform the user that the reference point has been successfully superposed. A reflective reference point can therefore be used not only to draw a user's attention to the area where the reference point 234 is to be superposed but also to confirm that the reference point 234 has been successfully superposed.

Figure 45:
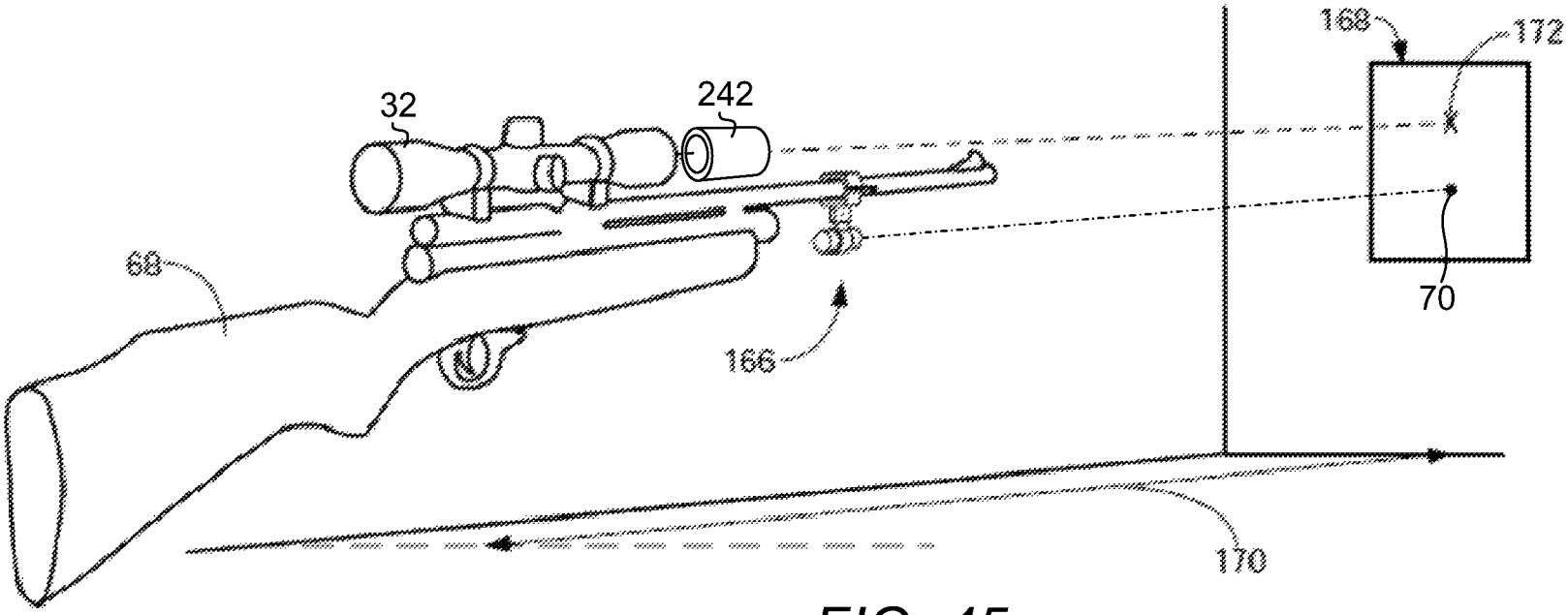
FIG. 45 depicts the use of one embodiment of a sight aid in conjunction with the present apparatus for zeroing a projectile device.
Figure 46:
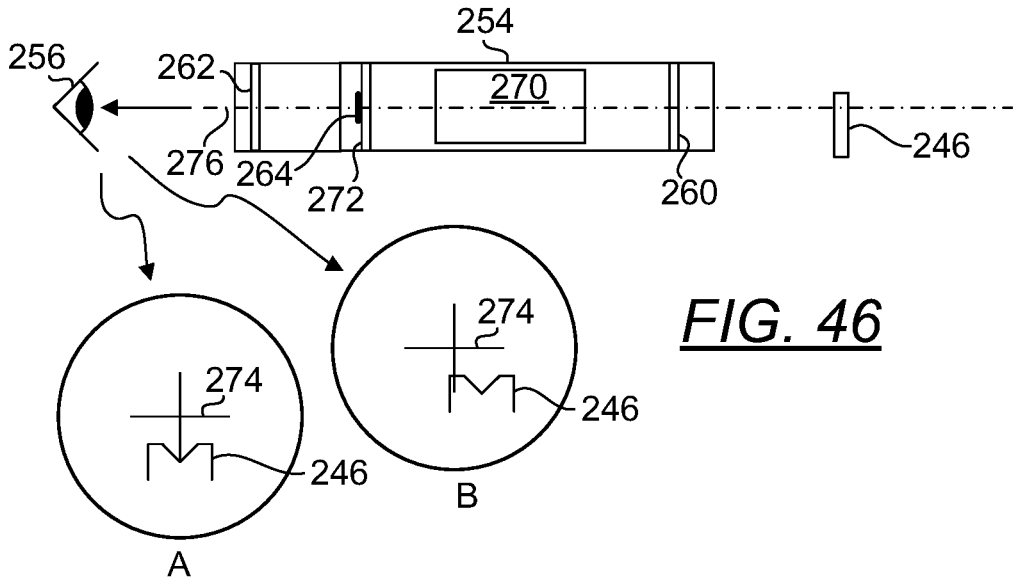
FIG. 46 depicts the use of another embodiment of a sight aid in conjunction with the present apparatus for zeroing a projectile device.
Figure 47:
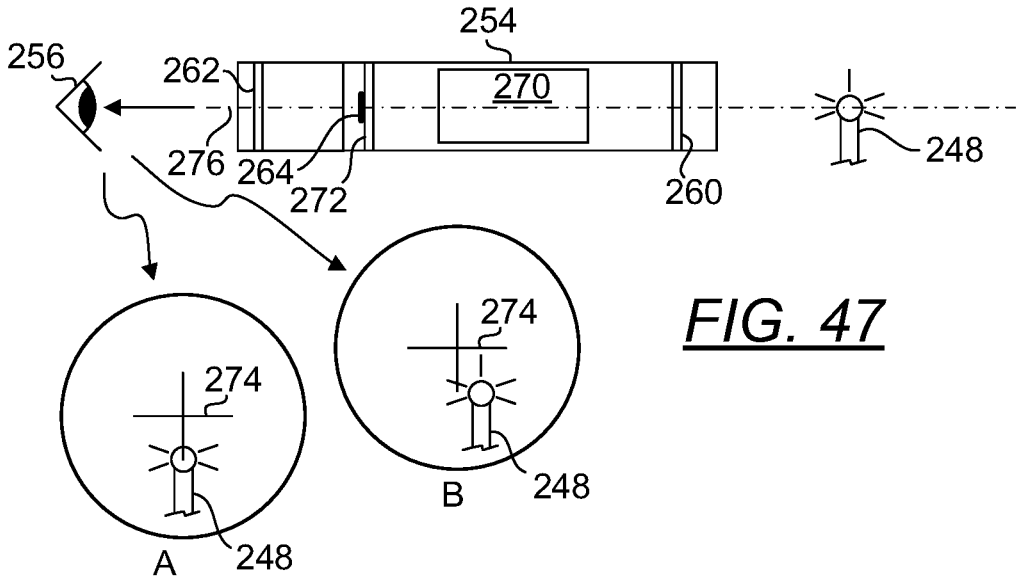
FIG. 47 depicts the use of yet another embodiment of a sight aid in conjunction with the present apparatus for zeroing a projectile device.
Figure 48:
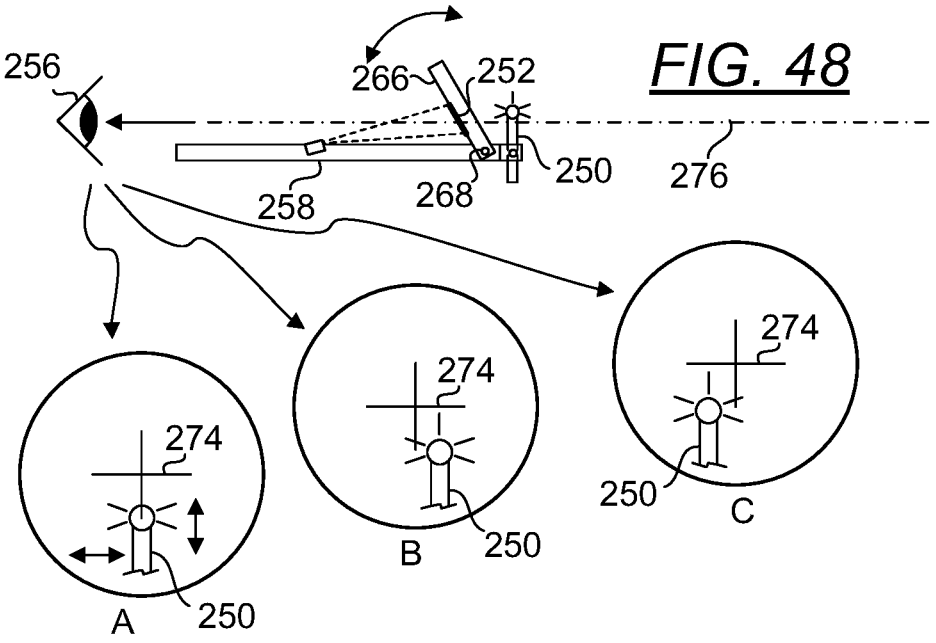
FIG. 48 is a diagrammatic side view of one embodiment of a sight aid adapted forward of or attached to a scope.

FIG. 45 depicts the use of one embodiment of a sight aid 242 in conjunction with the present apparatus for zeroing a projectile device. Applicant's U.S. patent application Ser. No. 14/569,637, filed Dec. 13, 2014, which is incorporated by reference in its entirety herein, discloses several embodiments of sight aid which can be optically coupled with a scope to further aid the alignment of the user's line of sight with one or more reference points 174, by removing, among other aspects, parallax. Therefore, in addition to the means for indicating the physical relationship of a projectile device and its target as disclosed elsewhere herein, the relationship of the projectile device to the user is indicated for increased precision in zeroing with a sight aid 242. FIG. 46 depicts the use of another embodiment of a sight aid in conjunction with the present apparatus for zeroing a projectile device. The sight aid 246 of FIG. 46 is essentially an "M" shaped structure having a substantially centrally disposed trough. FIG. 47 depicts the use of yet another embodiment of a sight aid in conjunction with the present apparatus for zeroing a projectile device. The sight aid 248 of FIG. 47 is essentially a post with an illuminator disposed on the top portion of the post. In the embodiments shown in FIGS. 46 and 47, the present sight aid is adaptable to a scope having a housing 254, an objective lens 260 mounted in the housing 254 at one end thereof for forming a target image and an ocular lens 262 mounted in the housing 254 at opposite end thereof and image-erecting optics 270. The objective and ocular lenses 260, 262 define an optical axis 276 through the housing 254 and the image-erecting optics 270 are mounted between the objective and ocular lenses 260, 262 on the optical axis 276 for erecting the image formed by the objective lens 260, the ocular lens 262 sharing a plane of focus on the optical axis 276 where the erected image is formed for viewing by the user as shown in the view point 256 of a user's eye. A reticle 272 is mounted within the housing 254 on the plane of focus, the reticle 272 having a sight alignment indicator 264 on the optical axis 276, an image thereof being viewable together with the target image formed by the objective lens 260 and the image-erecting optics 270 within the housing 254 to facilitate alignment of the scope with a target. In both FIGS. 46 and 47, scenario A depicts an image that results when a sight aid is at least aligned along the width of the image as viewed by a user through a scope. Scenario B depicts an image that results when a sight aid is not aligned along the width of the image. Referring to FIG. 46, it shall be noted that the vertical line of crosshairs 274 coincides with the substantially centrally disposed trough of sight aid 246 in scenario A while the vertical line of crosshairs 274 does not coincide with the trough of sight aid 246 in scenario B. A sight aid may be mounted forward of or attached to a scope. When using a sight aid in conjunction with a rifle, a cheek weld is established, which not only increases the precision in zeroing but also aiming when the rifle has subsequently been zeroed and used for subsequent shooting. It shall be realized from FIGS. 46 and 47 that, without a sight aid, aiming for the purpose of zeroing a projectile device or aiming for the purpose of aligning the projectile device before taking a shot of a target can be severely compromised. FIG. 48 is a diagrammatic side view of one embodiment of a sight aid adapted forward of or attached to a scope, where a projection device is integrally attached to the scope. Scenario A depicts an image that results when a sight aid is at least aligned along the width of the image as viewed by a user through a scope. Scenarios B and C depict images that result when a sight aid is not aligned along the width of the image. The projection device includes a projector 258 useful for projecting an image in the form of a supplementary sight alignment indicator 252 on a projection plane 266. The projection device is configured to be removable while not in use or when highly precise alignment is unnecessary. While not in use, the flip-mounted projection plane 266 may be collapsed upon the projection device about hinge 268 to protect the projection plane 266 from accidental impact. Referring to FIG. 48, it shall be noted that the vertical line of crosshairs 274 coincides with the sight aid 250 in scenario A. In this example, the sight aid 250 is capable of vertical adjustment such that the illuminator is vertically adjustable with respect to the crosshairs. A user may prefer to have the illuminator vertically aligned at a particular position so as not to obscure a target image and such adjustability provides the user the ability to do so. Further, a mount of sight aid 250 may need to be horizontally adjusted such that the orientation of the projectile device upon which the vertical line of crosshairs 274 coincides with the sight aid represents a condition where parallax has been eliminated. In one embodiment, a transparent, semi-transparent or translucent sight aid is preferable so as not to obscure a target image.

Having thus described several embodiments of the claimed invention, it will be rather apparent to those skilled in the art that the foregoing detailed disclosure is intended to be presented by way of example only, and is not limiting. Many advantages for the systems and methods for aligning a point of aim with a point of impact for a projectile device have been discussed, including the ability to quickly and accurately zero a projectile device with only one shot. The methods and systems herein may be used to establish, maintain, or resume the relationship between a point of aim and a point of impact. These methods and systems eliminate the need for calculations when zeroing a projectile device. The methods and systems also greatly reduce the number of projectiles needed to zero a projectile device. In the case of firearms, being able to use a single round (single projectile) to zero the weapon, the weapon will incur less barrel wear than a weapon which needs to be zeroed with multiple rounds. Fewer rounds also means the barrel undergoes less heat distortion. This may result in a more accurate zeroing process when compared to zeroing methods using more rounds since weapons zeroed using more rounds will eventually cool after the multiple rounds are fired, returning the barrel to a slightly (but noticeably) different position and thereby affecting its zero position. The methods and systems for aligning a point of aim with a point of impact for a projectile device also have the benefit of indicating improper shooting technique, improper scope mounting relative to a rifle bore, or both if zero is not readily achieved.

Various alterations, improvements, and modifications will occur and are intended to those skilled in the art, though not expressly stated herein. These alterations, improvements, and modifications are intended to be suggested hereby, and are within the spirit and the scope of the claimed invention. Additionally, the recited order of the processing elements or sequences, or the use of numbers, letters, or other designations therefore, is not intended to limit the claimed processes to any order except as may be specified in the claims. Accordingly, the claimed invention is limited only by the following claims and equivalents thereto.

What is claimed is:

1. A system for aligning a point of aim with a point of impact for a projectile device, the system comprising:

a scope configured to be coupled to the projectile device, the scope comprising:

a housing;

an objective lens and an ocular lens mounted at opposite ends of the housing;

an optical axis extending through the housing, the optical axis defined at least in part by the objective and ocular lenses; and a reticle mounted within the housing, the reticle having a sight alignment indicator disposed on the optical axis;

a sight aid configured to be coupled to at least one of the scope and the projectile device, the sight aid comprising a supplementary sight alignment indicator disposed on the optical axis and spaced-apart from the sight alignment indicator; and at least one superposition device configured to be coupled to the projectile device, the at least one superposition device comprising at least one illumination source for superposing multiple optical reference points onto a first target;

wherein, the point of aim is defined at least in part by the optical axis extending through the sight alignment indicator and the supplementary sight alignment indicator;

the point of impact is created on the first target by a projectile expelled from the projectile device; and the point of aim is adjustable to align with the point of impact while maintaining a position of at least one of the multiple optical reference points superposed on the first target.

2. The system of claim 1, wherein the point of aim is adjusted by adjusting one of the sight alignment indicator and the supplementary sight alignment indicator.

3. The system of claim 1, wherein the point of aim is adjusted by adjusting the sight alignment indicator and the supplementary sight alignment indicator.

4. The system of claim 1, wherein the point of impact is created on a second target by a projectile expelled from the projectile device towards the second target.

5. The system of claim 1, comprising a collimator for collimating the at least one illumination source.

6. The system of claim 1, wherein the sight aid comprises:

a projection device configured for projecting at least one reference point; and a projection plane spaced apart from the sight alignment indicator;

wherein, the supplementary sight alignment indicator is defined at least in part by the at least one reference point projected by the projection device onto the projection plane.

7. The system of claim 6, wherein at least a portion of the first target is viewable through the projection plane.

8. The system of claim 7, comprising a composite image defined at least in part by the sight alignment indicator, the supplementary sight alignment indicator, and the portion of the first target viewable through the projection plane.

9. The system of claim 6, wherein the at least one reference point is selected from the group consisting of a cross, a dot, a ring, a triangle, a line, a plurality of lines, a pin, and any combinations thereof.

10. The system of claim 1, comprising a composite image defined at least in part by the sight alignment indicator, the supplementary sight alignment indicator, and the first target.

11. The system of claim 1, wherein the supplementary sight alignment indicator is selected from the group consisting of a cross, a dot, a ring, a triangle, a line, a plurality of lines, a pin, and any combinations thereof.

12. The system of claim 1, wherein the supplementary sight alignment indicator is shaped and sized substantially similar to the sight alignment indicator, so that, when viewed along the optical axis, the sight alignment indicator and the supplementary sight alignment indicator are substantially coincident with each other.

13. The system of claim 1, wherein a line of sight extending through the scope and the optical axis are substantially coincident with each other; and adjusting the point of aim changes the line of sight.

* * * * *